US011831080B2

(12) United States Patent
Logan

(10) Patent No.: US 11,831,080 B2
(45) Date of Patent: Nov. 28, 2023

(54) BROADBAND OPERATION NOTCHED ACTIVE PHASED ARRAY RADIATOR WITH TREATED EDGES

(71) Applicant: The Government of the United States of America, as represented by the Secretary of the Navy, Arlington, VA (US)

(72) Inventor: John T. Logan, Fairfax, VA (US)

(73) Assignee: The Government of the United States of America, as represented by the Secretary of the Navy, Arlington, VA (US)

( * ) Notice: Subject to any disclaimer, the term of this patent is extended or adjusted under 35 U.S.C. 154(b) by 0 days.

(21) Appl. No.: 17/729,596

(22) Filed: Apr. 26, 2022

(65) Prior Publication Data

US 2023/0344148 A1 Oct. 26, 2023

(51) Int. Cl.

| | |
|---|---|
| ***H01Q 21/06*** | (2006.01) |
| ***H01Q 13/08*** | (2006.01) |
| ***H01Q 13/18*** | (2006.01) |
| ***H01Q 5/335*** | (2015.01) |

(52) U.S. Cl.
CPC ..... *H01Q 21/064* (2013.01); *H01Q 5/335* (2015.01); *H01Q 13/08* (2013.01); *H01Q 13/085* (2013.01); *H01Q 13/18* (2013.01)

(58) Field of Classification Search
CPC .... H01Q 21/064; H01Q 13/085; H01Q 13/18; H01Q 5/25; H01Q 5/335
See application file for complete search history.

(56) References Cited

U.S. PATENT DOCUMENTS

| | | | | |
|---|---|---|---|---|
| 7,652,631 | B2 * | 1/2010 | McGrath | H01Q 5/357 343/770 |
| 8,350,773 | B1 * | 1/2013 | Kindt | H01Q 21/068 343/770 |
| 8,736,504 | B1 * | 5/2014 | West | H01Q 13/106 343/770 |
| 9,105,983 | B2 * | 8/2015 | Pintos | H01Q 13/085 |
| 9,893,430 | B2 * | 2/2018 | Wang | H01Q 13/106 |
| 10,230,172 | B1 * | 3/2019 | Wolf | H01Q 21/064 |
| 11,303,040 | B2 * | 4/2022 | Stumme | H01Q 21/0025 |
| 11,450,962 | B1 * | 9/2022 | Gustafson | H01Q 21/0025 |
| 2003/0052828 | A1 * | 3/2003 | Scherzer | H01Q 5/42 343/795 |

FOREIGN PATENT DOCUMENTS

| | | | |
|---|---|---|---|
| CN | 108736147 A | * 11/2018 | |
| CN | 108963441 A | * 12/2018 | H01Q 1/36 |
| CN | 212676469 U | * 3/2021 | |

* cited by examiner

*Primary Examiner* — Vibol Tan
(74) *Attorney, Agent, or Firm* — US Naval Research Laboratory; William P. Ladd

(57) ABSTRACT

Systems and methods are provided for enabling a notch-based element that retains traditional notch ultra wideband (UWB) performance while having a highly-producible/-scalable structure, high power handling, a simple single-ended 50 ohm feeding, and relative insensitivity to a conductive back-plate. Embodiments of the present disclosure improve upon the traditional notch structure to further offer shorter element depth, lighter weight, and modularized assembly.

20 Claims, 30 Drawing Sheets

BROADBAND OPERATION NOTCHED ACTIVE PHASED ARRAY RADIATOR WITH TREATED EDGES

FEDERALLY SPONSORED RESEARCH AND DEVELOPMENT

The United States Government has ownership rights in this invention. Licensing inquiries may be directed to Office of Technology Transfer at US Naval Research Laboratory, Code 1004, Washington, D.C. 20375, USA; +1.202.767.7230; techtran@nrl.navy.mil, referencing Navy Case Number 111109-US2.

FIELD OF THE DISCLOSURE

This disclosure relates to antennas, including phased array antennas.

BACKGROUND

The notch antenna (also referred to as flared notch, tapered slot, or Vivaldi) is an element in microwave radio frequency (RF) ultra-wideband (UWB) electronically scanned array (ESA) apertures. Notch antennas have excellent matching over very wide bandwidths, a substantial range of manufacturability, and simple single-ended 50 ohm feeding. The notch electrical design process features an impedance transition to free-space over a contiguous stepped or tapered slot-line that is narrow at the cavity-end and wider towards the radiating-end; this can lead to the notch antenna being classified as an 'end-fire' element.

Existing notch-based element designs remain non-modular due to their contiguous adjacent element connection and continue to exhibit excessive volume and/or weight concerns. There is a need for a notch-based element that retains its traditional advantageous features, i.e., UWB performance, highly-producible/-scalable structure, simple single-ended 50 ohm feeding, and relative insensitivity to a conductive back-plate, yet also improves upon the structure to further offer shorter element depth, lighter weight, and modularized assembly.

BRIEF DESCRIPTION OF THE DRAWINGS/FIGURES

The accompanying drawings, which are incorporated in and constitute part of the specification, illustrate embodiments of the disclosure and, together with the general description given above and the detailed descriptions of embodiments given below, serve to explain the principles of the present disclosure. In the drawings.

Figure 1:
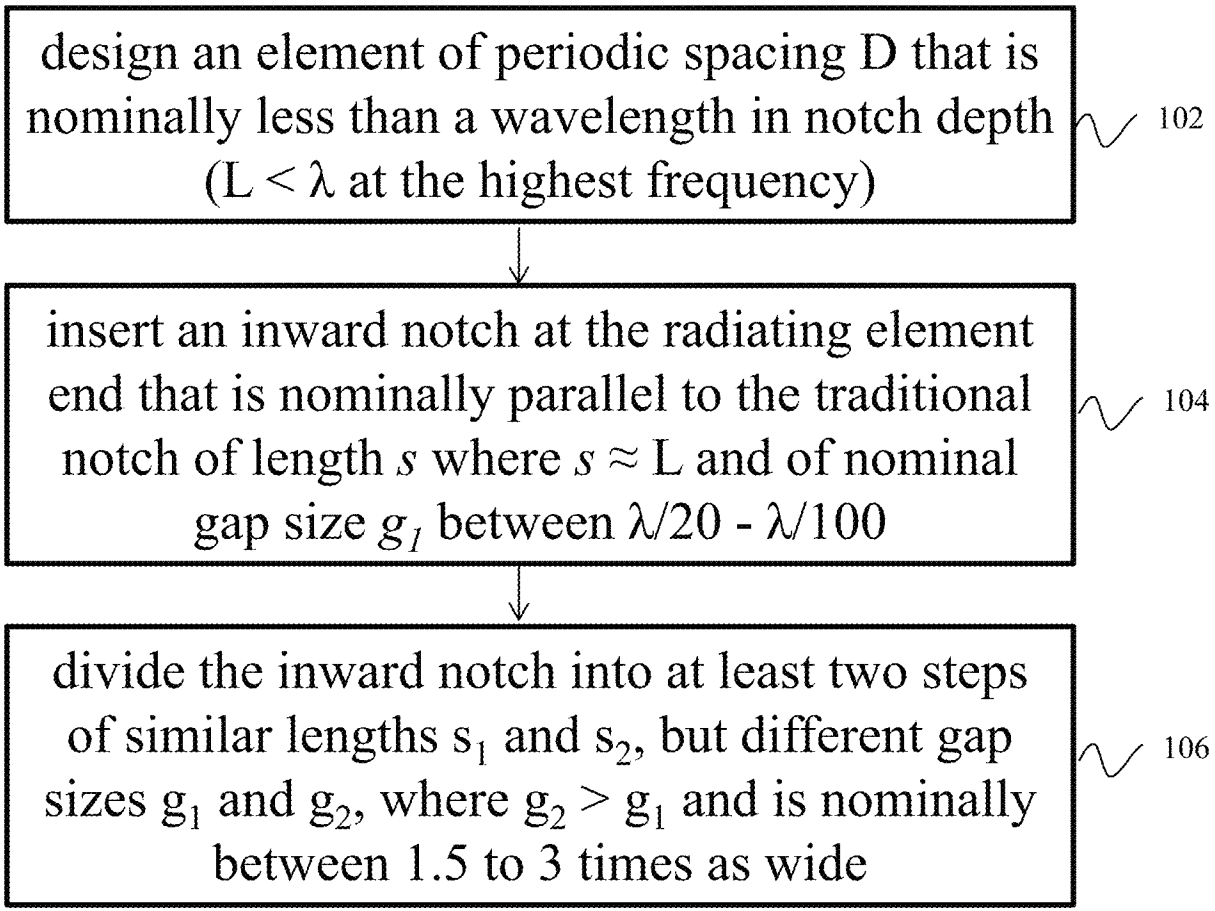
FIG. 1 is a diagram showing an exemplary design process for a notch phased array antenna in accordance with an embodiments of the present disclosure.

Features and advantages of the present disclosure will become more apparent from the detailed description set forth below when taken in conjunction with the drawings, in which like reference characters identify corresponding elements throughout. In the drawings, like reference numbers generally indicate identical, functionally similar, and/or structurally similar elements. The drawing in which an element first appears is indicated by the leftmost digit(s) in the corresponding reference number.

DETAILED DESCRIPTION

In the following description, numerous specific details are set forth to provide a thorough understanding of the disclosure. However, it will be apparent to those skilled in the art that the disclosure, including structures, systems, and methods, may be practiced without these specific details. The description and representation herein are the common means used by those experienced or skilled in the art to most effectively convey the substance of their work to others skilled in the art. In other instances, well-known methods, procedures, components, and circuitry have not been described in detail to avoid unnecessarily obscuring aspects of the disclosure.

References in the specification to "one embodiment," "an embodiment," "an exemplary embodiment," etc., indicate that the embodiment described may include a particular feature, structure, or characteristic, but every embodiment may not necessarily include the particular feature, structure, or characteristic. Moreover, such phrases are not necessarily referring to the same embodiment. Further, when a particular feature, structure, or characteristic is described in connection with an embodiment, it is submitted that it is within the knowledge of one skilled in the art to understand that such description(s) can affect such feature, structure, or characteristic in connection with other embodiments whether or not explicitly described.

1. Overview

Embodiments of the present disclosure provide a notch-based element that retains traditional notch ultra wideband (UWB) performance while having a highly-producible/-scalable structure, high power handling, a simple single-ended 50 ohm feeding, and relative insensitivity to a conductive back-plate. Embodiments of the present disclosure improve upon the traditional notch structure to further offer shorter element depth, lighter weight, and modularized assembly.

2. Notch Antennas

In notch-based elements, the impedance performance (i.e., RF matching) of the element is relatively insensitive to the presence of a conductive ground plane or back-plate, which can be used to shield backing electronics from electromagnetic interference (EMI). This feature can be attributed to the 'end-fire' nature of the element and can provide a risk mitigation advantage over ESA apertures that may use elements based on antennas with bi-directional 'butterfly' patterns in free-space, (e.g., dipoles or slots). With a dipole or slot element design, a contiguous conductive ground plane or back-plate is incorporated to act as a reflector to produce uni-directional radiation, understandably becoming very sensitive to the ground plane's presence as it becomes an integral part of the impedance transformation to free-space. Because ground plane imperfections such as noncontiguous gaps between elements or array modules can notably result in spurious resonances, dipole or slot arrays are thus seldom treated with resistive materials to mitigate ground plane sensitivity at the expense of reduced aperture gain since half of the bi-directional radiation is dissipated in the resistive material rather than reflected uni-directionally.

Notch-based antenna elements have a few notable design challenges. Notch elements require contiguous electrical connection between adjacent elements to avoid spurious resonances within the operating band, which tends to complicate the assembling or disassembling of notch-based antenna arrays as sub-array modules. Another challenge is the notch structure has the propensity to require deeper tapers to support wider operational bandwidths, thus restricting their use on certain platforms with stringent weight, volume, and polarization purity requirements. On critical radar and communication operations utilizing RF frequency below C-band, a notch element can have considerable physical depth, e.g., around one meter at L-band.

The structures of most dipole-based elements do not generally lend themselves to the same scalable and robust fabrication methods that notch-based elements do, and additional touch labor is also often needed for assembly instead of automated processes, especially in dual-polarization array configuration cases. For effective radiation, dipoles operate in the differential mode such that extra circuitry or design techniques are required to ensure the feed lines remain appropriately balanced. Planar printed circuit board (PCB) approaches tend to have material stackups that become too bulky to be fabricated at lower RF bands. Dielectric superstrates or frequency-selective surfaces (FSS) are also often necessary to aid wide-angle impedance matching, which can add RF losses and increase complexity. In certain cases, the dipole arm is partly comprised of a floating pin that is difficult to align and/or connect with an external feed connector. As noted previously, dipole-based elements are also highly sensitive to the conductive back-plate presence, which can introduce risk and complications during integration with the system front-end. Most of the prior features culminate in dipole arrays that require several or many different parts, and a higher number of total parts, to maintain UWB performance, ultimately increasing cost and risk. Though showing much potential in terms of weight and volume reduction in comparison with notch-based antenna arrays, the prior features in part constrain the current TRL of dipole-based antenna arrays, thus notch-based antenna arrays still tend to see more practical use.

3. Phased Array Antennas

A phased array antenna in accordance with an embodiment of the present disclosure includes a plurality of antenna elements that each have a feed input along a main axis of the antenna element body. In an embodiment, the feed input extends into the antenna element body from an outer surface at a first end of the antenna element body, into a first slot-line having a bend with respect to the main axis of the antenna element body, adjoined to a slot-line cavity on one end of the first slot-line forming a cavity enclosure with a preferably conductive wall, and adjoined to a second slot-line on the opposite end of the first slot-line that is offset from the main axis. In an embodiment, the second slot-line extends into a shaped slot-line along a main axis of the antenna element body, defined by a mostly outwardly tapered opening at a second end of the antenna element body, to a second slot-line end proximate to a first capacitively-coupled gap end between the antenna element body and an adjacent antenna element, extending inwardly towards the first end of the antenna element body with respect to the main axis of the antenna element body, into a second gap end that is wider than the first gap end and proximate to the first end of the antenna element body.

3.1. Cylindrical Phased Array

Legacy cylindrical phased array systems are constrained to narrowband operation due to antenna element limitations amid a growing need to support advanced multifunctional platform requirements. Embodiments of the present disclosure provide a notch-based all-metal ultrawideband antenna element suitable for cylindrical arrays. In an embodiment, the element is designed to operate over 2.75-10 GHz while being highly amenable to a cylindrical architecture via modularized assembly of compact scalable column facets. In an embodiment, the element includes a new shunt-loaded stepped-impedance gap design scheme to improve low-frequency performance without increasing profile and the design of a tongue-and-groove azimuthal crosswall that precisely conforms to the wedge-shaped unit cell for simple yet robust cylinder assembly.

Cylindrical phased arrays are of interest for communication and radar applications requiring rapid and persistent 360° coverage due to their scan-invariant azimuthal directivity, beamwidth, sidelobe level, and polarization purity. These properties can ease legacy performance constraints intrinsic to multi-faced planar array systems related to beam broadening, cross-polarization isolation, and calibration.

The curved aperture of a cylindrical array complicates construction, historically limiting large-scale demonstrator apertures to narrowband dipole or patch elements. Narrowband radiators tend to have manufacturing advantages due to their thin depth with respect to the element pitch (i.e., the variation along the radial dimension of the wedge-shaped unit cell is negligible) and a relatively weak dependence on mutual coupling for impedance matching. These benefits enable traditional planar microstrip fabrication methods to be conveniently reused, such that linear column arrays can be assembled as modular facets around a cylindrical architecture with small tolerable gaps. Traditional wideband elements, rather, are of notable depth with sensitive coupling requirements between adjacent elements, complicating cylindrical array construction and imposing specialized design and integration treatment.

Embodiments of the present disclosure provide a shunt-loaded UWB notch element that facilitate ease of aperture assembly and scalability for cylindrical arrays, while offering up to 30% improved bandwidth compared to a conventional compact notch of equal profile. Embodiments of the present disclosure enable the reconfiguration of the connected metal area between adjacent elements into a devised shunt-loaded stepped-impedance (SI) slotline scheme to lower the array cutoff frequency without increasing element depth, manufacturing complexity, or manifesting known gap-induced resonances. In an embodiment, elements are fabricated as columns from a block of aluminum stock using high precision multi-axis electrical discharge machining (EDM) for repeatable and scalable production. In an embodiment, modularized aperture assembly is enabled by designing an azimuthal tongue-and-groove crosswall that conforms to the wedge-shaped unit cell for robust press-fit integration of column facets. In an embodiment, a 120°-arc sector prototype array is built as a first proof-of-concept to validate mechanical integrity and electrical embedded element performance over a 2.75-10 GHz operating band.

3.2. Shunt-Loaded Notch Element

In an embodiment, a cylindrical array element was designed for a multifunction system with an operational need for over 3:1 instantaneous bandwidth, a high-frequency ($f_{high}$) of 10 GHz, persistent electronic scan coverage across 360° in azimuth, and up to 30° scan capability in elevation. The full active can be contained within a 12" (300 mm) diameter cylinder (approximately 10λ at $f_{high}$) and can offer a high degree of aperture survivability and scalability.

Figure 2A:
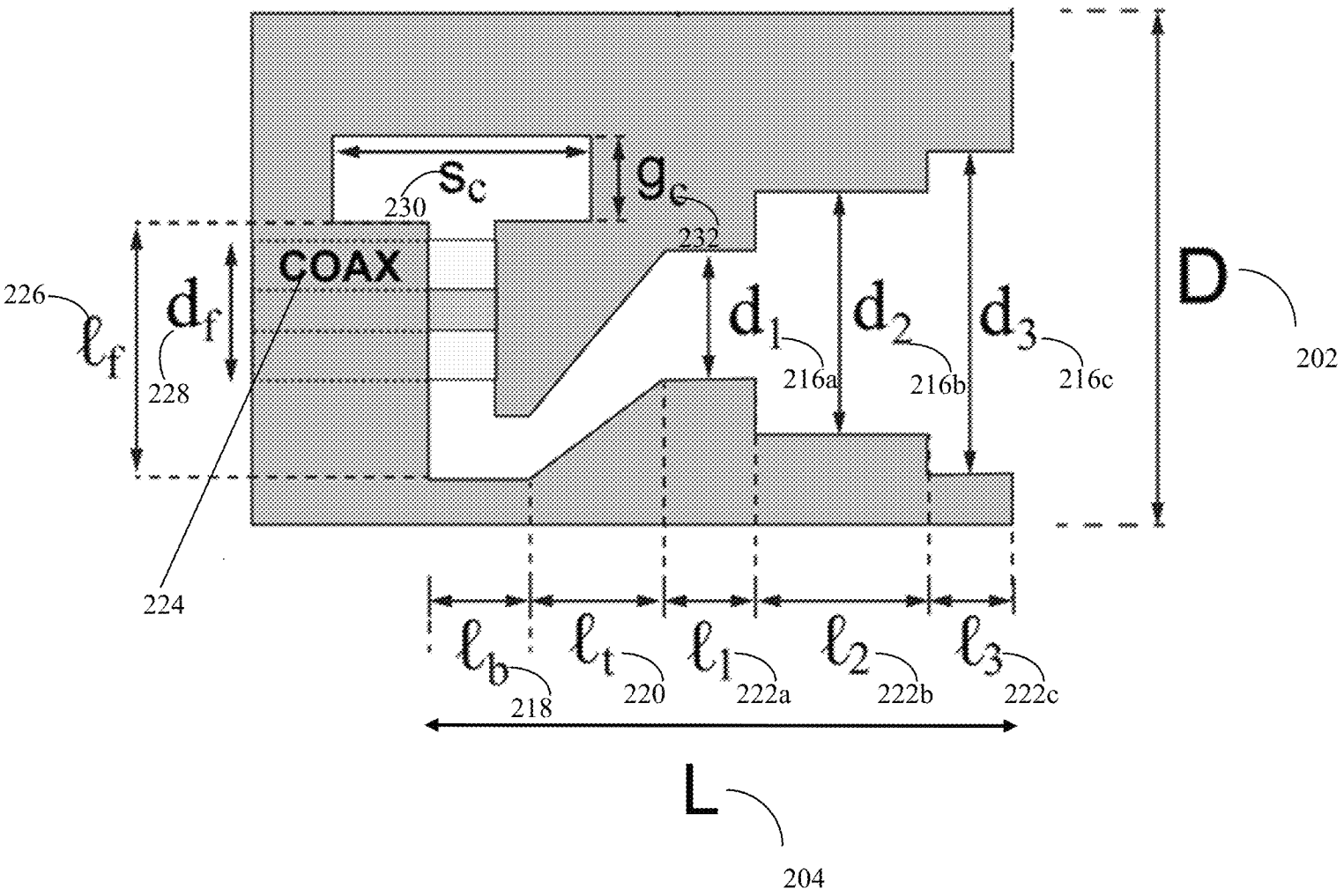
FIGS. 2A-2C are diagrams illustrating side views of a notch phased array antenna in accordance with an embodiments of the present disclosure.
Figure 2B:
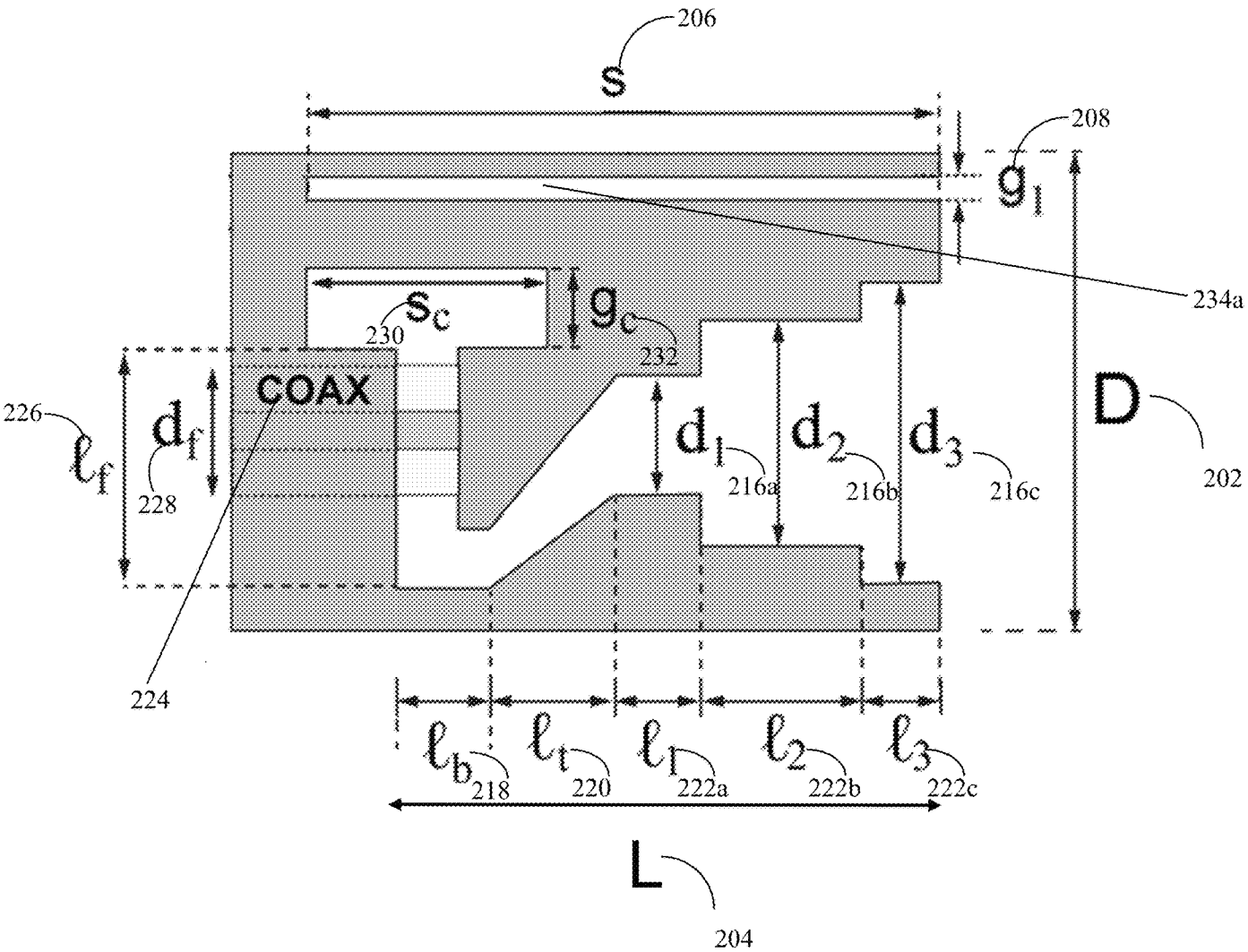
Figure 2C:
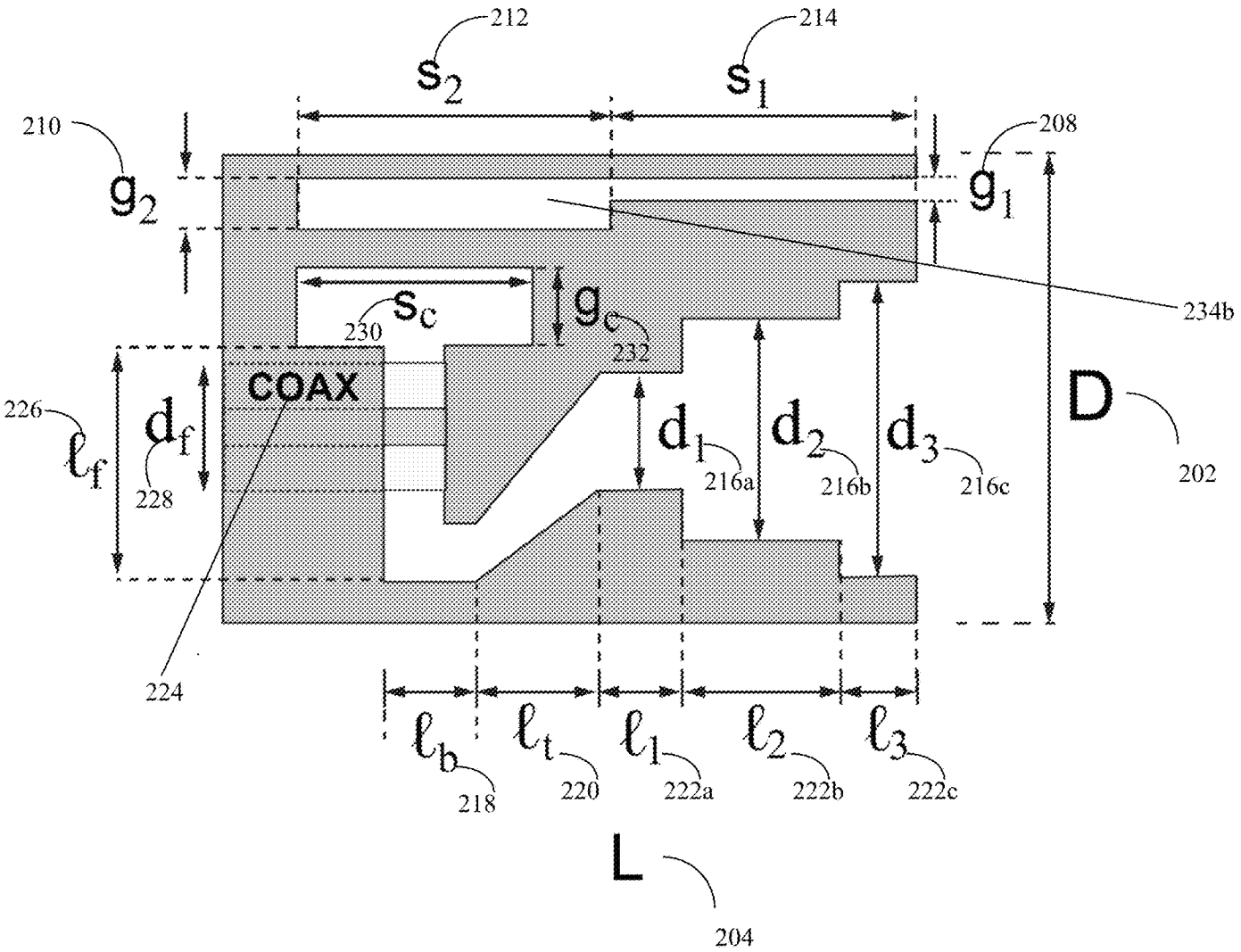

FIGS. 2A-2C are diagrams illustrating side views of a notch phased array antenna in accordance with an embodiments of the present disclosure. In FIG. 2A, an element of periodic spacing D is designed that is nominally less than a wavelength in notch depth (L<λ at the highest frequency). For example, FIG. 2A shows an array element with periodic spacing D 202 with notch depth L 204. FIG. 2B shows an inward notch having length s 206 and gap size $g_1$ 208. FIG. 2C shows how the inward notch of length s 206 is divided into steps of lengths $s_1$ 212 and $s_2$ 214 but different gap sizes $g_1$ 208 and $g_2$ 210.

In FIGS. 2A-2C, s 206, $s_1$ 212, and $s_2$ 214 represent notch lengths, and $g_1$ 208 and $g_2$ 210 represent gap sizes. In FIGS. 2A-2C, $d_1$, $d_2$, and $d_3$ 216 are steps for a taper and provide a smooth impedance transition from a low impedance near the coaxial feed 224 to a higher space at the radiating end. In FIGS. 2A-2C, $\ell_b$ 218 represents bend length, $\ell_t$ 220 represents the length of the taper, $\ell_1$, $\ell_2$, and $\ell_3$ 222 represent lengths for steps, $\ell_f$ 226 represents the length of the coaxial feed 224 slot, $d_f$ 228 represents the diameter of the cable, $s_c$ 230 represents the length of the cavity, and $g_c$ 232 represents the height of the cavity. In FIGS. 2A-2C, the cavity with length $s_c$ 230 and height $g_c$ 232 can be used to help impedance matching between the coaxial feed 224 and free space. Exemplary dimensions for elements in FIGS. 2A-2C are given in Table 1:

TABLE 1

| Nominal Element Dimensions (mm) | | | | | | | | |
|---|---|---|---|---|---|---|---|---|
| $D(D_{AX})$ | $D(D_{AZ})$ | $d_f$ | $\ell_f$ | $\ell_b$ | $\ell_t$ | $\ell_1$ | $\ell_2$ | $\ell_3$ |
| 15 | 15 | 4.1 | 0.3 | 7.6 | 4.9 | 2.5 | 5.1 | 2.5 |
| $d_1$ | $d_2$ | $d_3$ | $s_1$ | $s_2$ | $g_1$ | $g_2$ | $s_c$ | $g_c$ |
| 3.8 | 7.0 | 9.5 | 10 | 10 | 0.64 | 1.6 | 7.6 | 2.5 |

In an embodiment, for low-sidelobe operation, elements are spaced λ/2 at $f_{high}$ in the axial and azimuthal directions to mitigate the impact of creeping wave phenomena on pattern ripple; this corresponds to a 2π/N angular spacing of 5° in azimuth to complete a 6" (150 mm) circle radius with N=72 elements. In an embodiment, the element is roughly 0.2λ thick in the core section and 0.9λ long at $f_{high}$ (less than 30 mm), allowing 80% of the inner cylinder volume to be used for electronics, cabling, and cooling. In an embodiment, a hole is drilled through the element bottom to expose the slotline for press-fit feeding of an SMA connector. Embodiments of the present disclosure include a shunt-loaded gap 234 at radiating-end, fully integrated within the notch body. This shut-loaded gap 234 plays a key role to enable lower array cutoffs without increasing profile. In an embodiment, shut-loaded gap 234 can be formed with a single cavity into the element, as shown by shut-loaded gap 234*a* in FIG. 2B. In an embodiment, shut-loaded gap 234 can be formed using one or more steps inside a cavity in the element, as shown by shut-loaded gap 234*b* in FIG. 2C.

In an embodiment, the element is designed with azimuthal shiplap crosswalls, tapered at the angular spacing along the cylinder radius, to constitute tongue-and-groove miter joints when arrayed in a column. This facilitates seamless press-fit mating between column facets at an equidistant spacing D 202, for simple yet robust modularized assembly around the circumference and ease of disassembly for maintenance and hardware upgrades.

In an embodiment, columns are fabricated from lightweight aluminum stock using high-precision four-axis EDM wire-cutting with tolerances regularly held at +/−0.002" for repeatable and scalable manufacturing. In an embodiment, a single-axis cut is first made along the axial dimension to carve the shunt-loaded notch structure, followed by two inward cuts to form the cavity and crosswalls between adjacent elements, and lastly two radial cuts at fixed miter angles to precisely sculpt the wedge-shaped unit cell. Column facets can be bolted to an inner EMI-shielded platform. Low electrical inter-dependence between antenna and platform, owing to the propensity for notch-type elements to radiate unidirectionally without a backing reflector, can notably reduce technical risk associated with platform integration.

Traditional notch arrays trade increased profile for lower array cutoff frequencies, resulting in ultrawideband (UWB) apertures of notable bulk that impose platform constraints. For the case of a cylindrical array, premium inner diameter real estate can be markedly truncated. Notch elements stand to benefit from broadbanding techniques at compact element depths, without altering the core of the tried-and-tested structure. This need motivated a strategic reconfiguration of the electrically connected shunt path between adjacent elements to enable lower achievable cutoffs without increasing profile.

Figure 3:
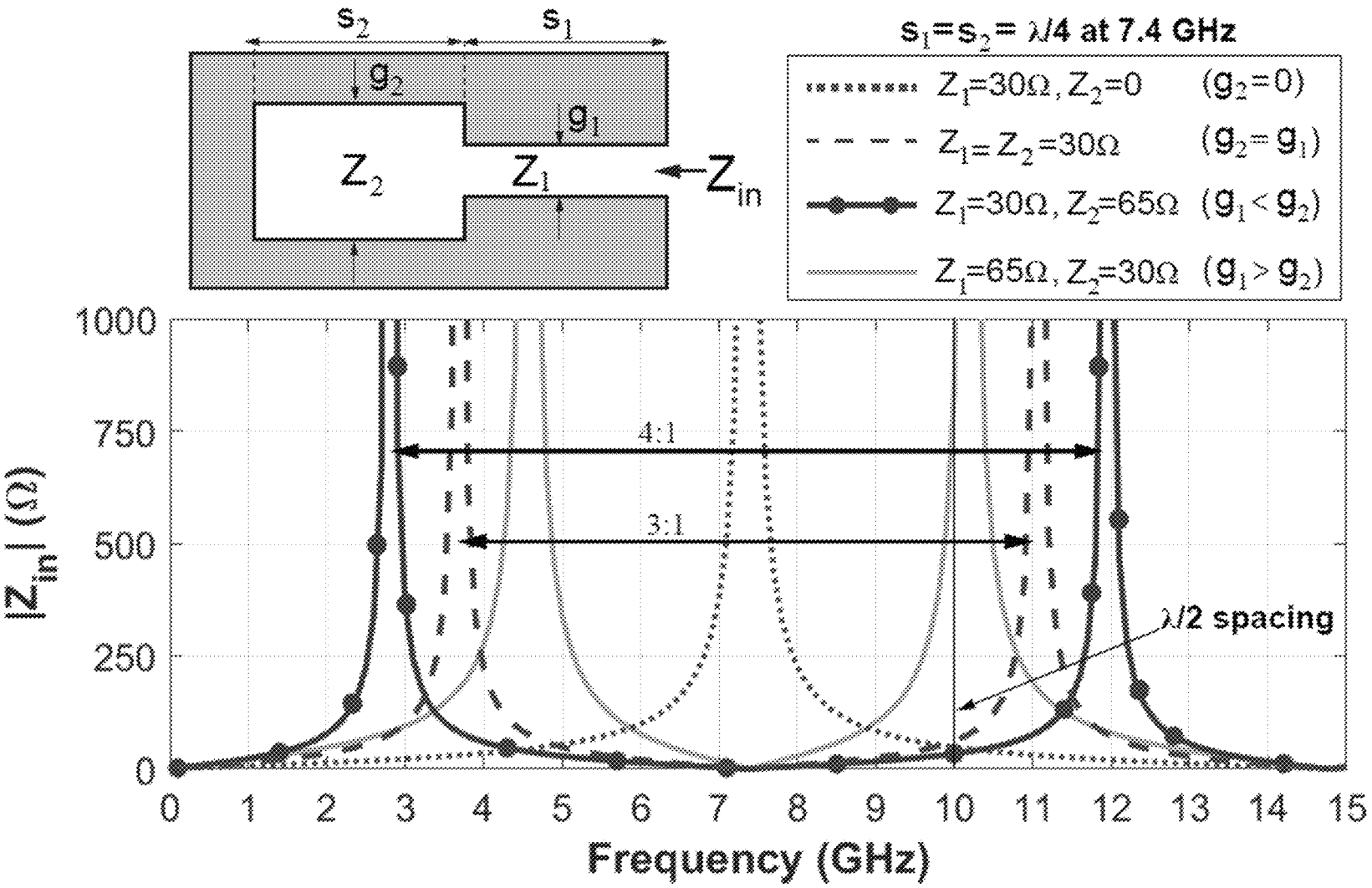
FIG. 3 is a diagram illustrating simulated input impedance magnitude for equivalent transmission line resonator circuit models with varying step impedance in accordance with an embodiment of the present disclosure.

FIG. 3 is a diagram illustrating simulated input impedance magnitude for equivalent transmission line resonator circuit models with varying step impedance (gap widths $g_1$, $g_2$) in accordance with an embodiment of the present disclosure. In an embodiment, structures are analogous to short-circuited transmission line resonators with unique bandpass properties dictated by gap width and length, and are representative of potential shunt-loaded gaps that could be integrated within the solid-metal notch body. From a radiation perspective, each resonance represents a new mode that does not exist in the original notch, with lower and upper cutoffs set by the fundamental and first-order resonant frequencies. Uniform-width gaps (dashed-lines) resonate at λ/4 lengths and odd-multiples, and are synonymous with problematic gap-induced resonances in notch elements; elements are treated in practice to emulate closed-gap behavior and avoid in-band impedance disruptions.

In an embodiment, instead of closing gaps, they can be advantageously reconfigured in accordance with an embodiment of the present disclosure to yield more favorable UWB characteristics in the original element. A wider resonant frequency separation and lower fundamental cutoff can be achieved with design of the impedance ratio, $K=Z_2=Z_1$, through SI resonator theory. As one example, a simple SI-gap with $K\approx 2$ (circle-markers) is shown to lower cutoff and improve resonance separation bandwidth by 30% up to 4:1 in FIG. 3. In an embodiment, SI gaps with $K<1$ (solid-line) are prohibitive, as the effective resonator length is decreased and dominant passband is narrower (though useful to widen higher-order stopbands in bandpass filters).

Figure 4:
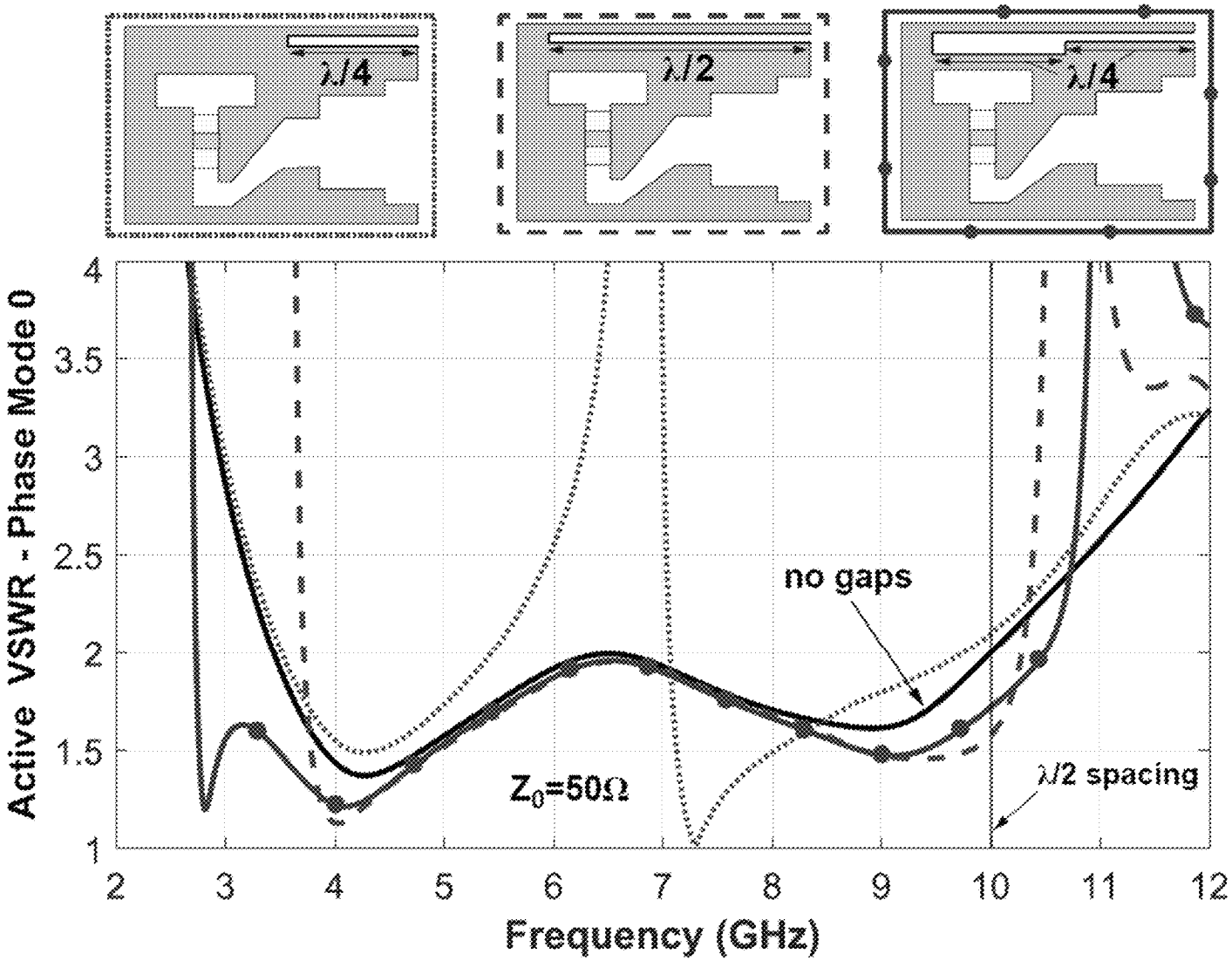
FIG. 4 is a diagram illustrating the impact of three shunt-loaded gap designs on the active VSWR (phase mode 0) of an infinite cylindrical array element in accordance with an embodiment of the present disclosure.

FIG. 4 is a diagram illustrating the impact of three shunt-loaded gap designs on the active VSWR (phase mode 0) of an infinite cylindrical array element in accordance with an embodiment of the present disclosure. In an embodiment, results shown in FIG. 4 for the active VSWR of an infinite cylindrical array element under basic omnidirectional excitation (i.e., "phase mode 0") are further representative of the planar array counterpart at broadside scan. Resonant frequencies agree well with circuit predictions, albeit uniformly shifted down in frequency by 10% due to fringing effects not incorporated in the circuit model. Uniform-width resonators (K=1) exhibit expected disruptive λ/4 resonances prohibitive to the no-gap case. The devised SI gap scheme lowers cutoff nearly 30% by way of the discussed principles, from 3.4 to 2.6 GHz, while pushing the first spurious mode further above the band.

In an embodiment, the shunt-loaded SI structure is etched from the solid metal body as part of usual machining. In an embodiment, lower cutoffs are achievable as constrained by microwave filter theory and physical implementation area, for example by: (1) increasing K at a trade-off for elevated passband insertion loss; and (2) increasing aggregate step length before spurious modes manifest beneath the λ/2 array spacing. Findings can be extended to printed structures and planar arrays but are employed here to particularly benefit a broadband cylindrical array of relatively small diameter.

3.3. Element Phase-Mode Impedance

In an embodiment, the electrical and mechanical insights outlined in the previous section can be used to design and demonstrate a cylindrical shunt-loaded notch array with stable phase-mode impedance operating over 2.75-10 GHz. In an embodiment, the analysis of active cylindrical array impedance requires different treatment than planar array counterparts since elements occupy wedge-shaped unit-cells that radiate a finite number of eigenmodes—often referred to as phase modes. Phase modes have constant amplitude and contain a periodic phase-shift across elements dictated by the phase mode index, m, that defines the number of complete phase cycles around a circumference of radius a. Any array excitation can be decomposed into a linear combination of phase-mode components. In an embodiment, usable phase modes are governed by a frequency-dependent bound of $-m_{max}<m\leq m_{max}$, where:

$$m_{max} = \frac{2\pi a}{\lambda} < \frac{N}{2} \tag{1}$$

and N is the number of columns required to complete a cylinder; modes outside this region manifest as higher-order distortion terms. In an embodiment, the active reflection coefficient of a cylindrical array element (p, q) for the $m_{th}$ phase-mode excitation can be calculated as:

$$\Gamma_{pq}^{m}(\psi_z) = \sum_{r=0}^{R-1}\sum_{c=0}^{C-1} S_{rc,pq} e^{j(r-p)\psi_z} e^{j(z-q)\frac{2\pi}{N}m} \tag{2}$$

where $\phi_x=kD_{AX}\cos\theta$ is the free-space phase-shift between elements within a column when scanning to θ, R and C are the number of rows and columns, and $S_{rc,pq}$ are the measured S-parameter mutual coupling between elements rc and pq. In an embodiment, for the built sector array, 167 coupling measurements were used to calculate the active impedance of an element.

4. Exemplary Design Process

FIG. 1 is a diagram showing an exemplary design process for a notch phased array antenna in accordance with an embodiments of the present disclosure. FIGS. 2A-2C are diagrams illustrating respective steps of the design process of FIG. 1. The steps of FIG. 1 will now be described with reference to FIGS. 2A-2C, which are diagrams illustrating side views of a notch phased array antenna in accordance with an embodiments of the present disclosure. In step 102, an element of periodic spacing D is designed that is nominally less than a wavelength in notch depth ($L<\lambda$ at the highest frequency). For example, FIG. 2A shows an array element with periodic spacing D 202 with notch depth L 204.

In step 104, an inward notch is inserted at the radiating element end that is nominally parallel to the traditional notch of length s where s L and of nominal gap size $g_1$ between $\lambda/20$-$\lambda/100$. For example, FIG. 2B shows an inward notch having length s 206 and gap size $g_1$ 208.

Gap-induced resonances can manifest from gaps of relatively fixed width between adjacent elements as in FIG. 2B and may arise incidentally in practice from tolerancing or assembly errors. Such gaps can be treated as shorted transmission line stubs, which may understandably give rise to problematic resonances within the operating band if sizable. In an embodiment of the present disclosure, a stepped impedance gap arrangement can be used instead of ensuring the gaps are filled, as in FIG. 2A, thus yielding an improved low-pass response without creating spurious in-band resonances.

For example, in step 106, the inward notch of length s is divided into at least two steps of similar lengths $s_1$ and $s_2$ but different gap sizes $g_1$ and $g_2$, where $g_2>g_1$ and is nominally between 1.5 to 3 times as wide. For example, FIG. 2C shows how the inward notch of lengths 206 is divided into steps of lengths $s_1$ 212 and $s_2$ 214 but different gap sizes $g_1$ 208 and $g_2$ 210.

In an embodiment, the low-pass response can be tuned as a function of step characteristic impedance (e.g., gap sizes g1 208 and g2 210), electrical lengths (s1 214 and s2 212), and filter order (e.g., the number of steps) to adjust the cutoff frequency. Providing steps can be beneficial with respect to removing gaps entirely since the designer can use this to lower the array cutoff frequency without increasing the element profile, thus reducing size and weight.

5. Exemplary Embodiments

As discussed above, shut-loaded gap 234 can be formed using one or more steps inside a cavity in the element, as shown by shut-loaded gap 234*b* in FIG. 2C. In an embodiment, shut-loaded gap 234 can be formed with a single cavity into the element, as shown by shut-loaded gap 234*a* in FIG. 2B. In an embodiment, shut-loaded gap 234 can be formed using one or more steps inside a cavity in the element, as shown by shut-loaded gap 234*b* in FIG. 2C.

Multiple configurations for the cavity of shut-loaded gap 234 and the cavity providing a smooth impedance transition from a low impedance near an input power feed (e.g., such as a feed for a coaxial cable) to a higher impedance at the radiating end are possible in accordance with embodiments of the present disclosure. Multiple lengths or depths for shut-loaded gap 234 are possible in accordance with embodiments of the present disclosure. In an embodiment, shut-loaded gap 234 is positioned above the cavity connected to the input power feed. In an embodiment, the overall length of shut-loaded gap 234 should be less than $\lambda/2$. In an embodiment, shut-loaded gap 234 is parallel with the cavity connected to the input power feed. In an embodiment, the length of shunt-loaded gap 234 is approximately equal to the length of the cavity connected to the input power feed. In an embodiment, shut-loaded gap 234 can be filled with air. In an embodiment, shut-loaded gap 234 can be filled with a material, such as a dielectric.

Figure 5A:
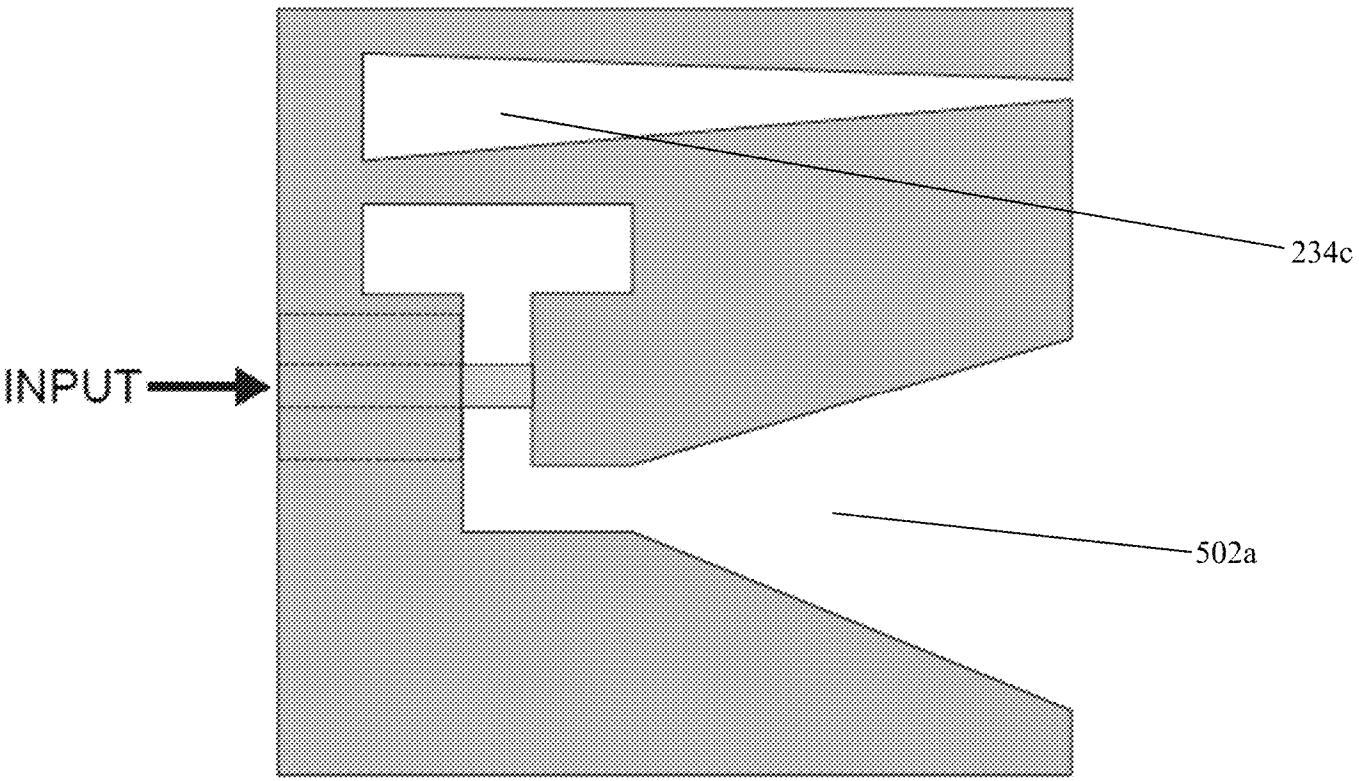
FIGS. 5A-5G show different possible configurations of an element including a shut-loaded gap 234 in accordance with embodiments of the present disclosure.
Figure 5B:
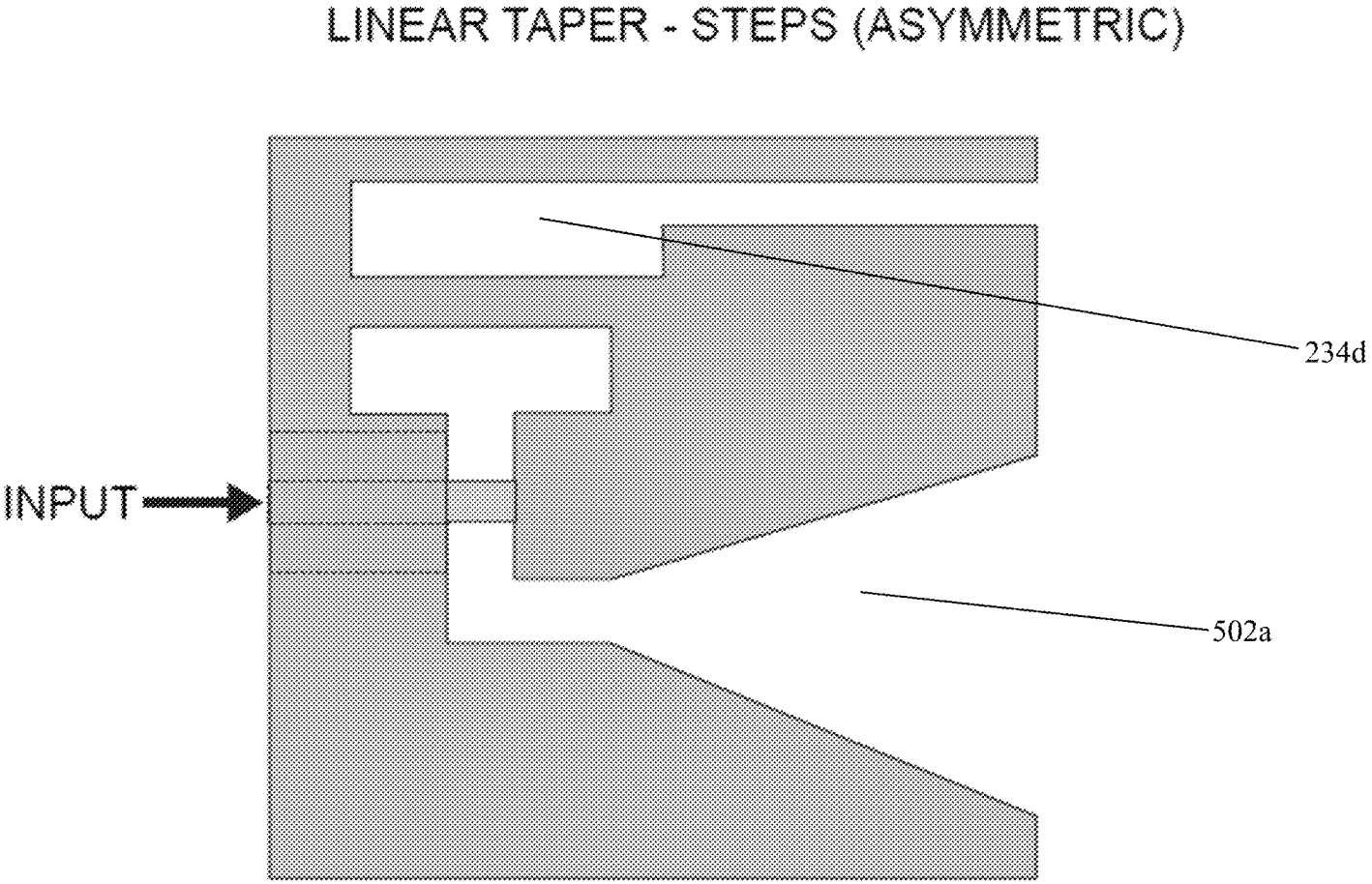
Figure 5C:
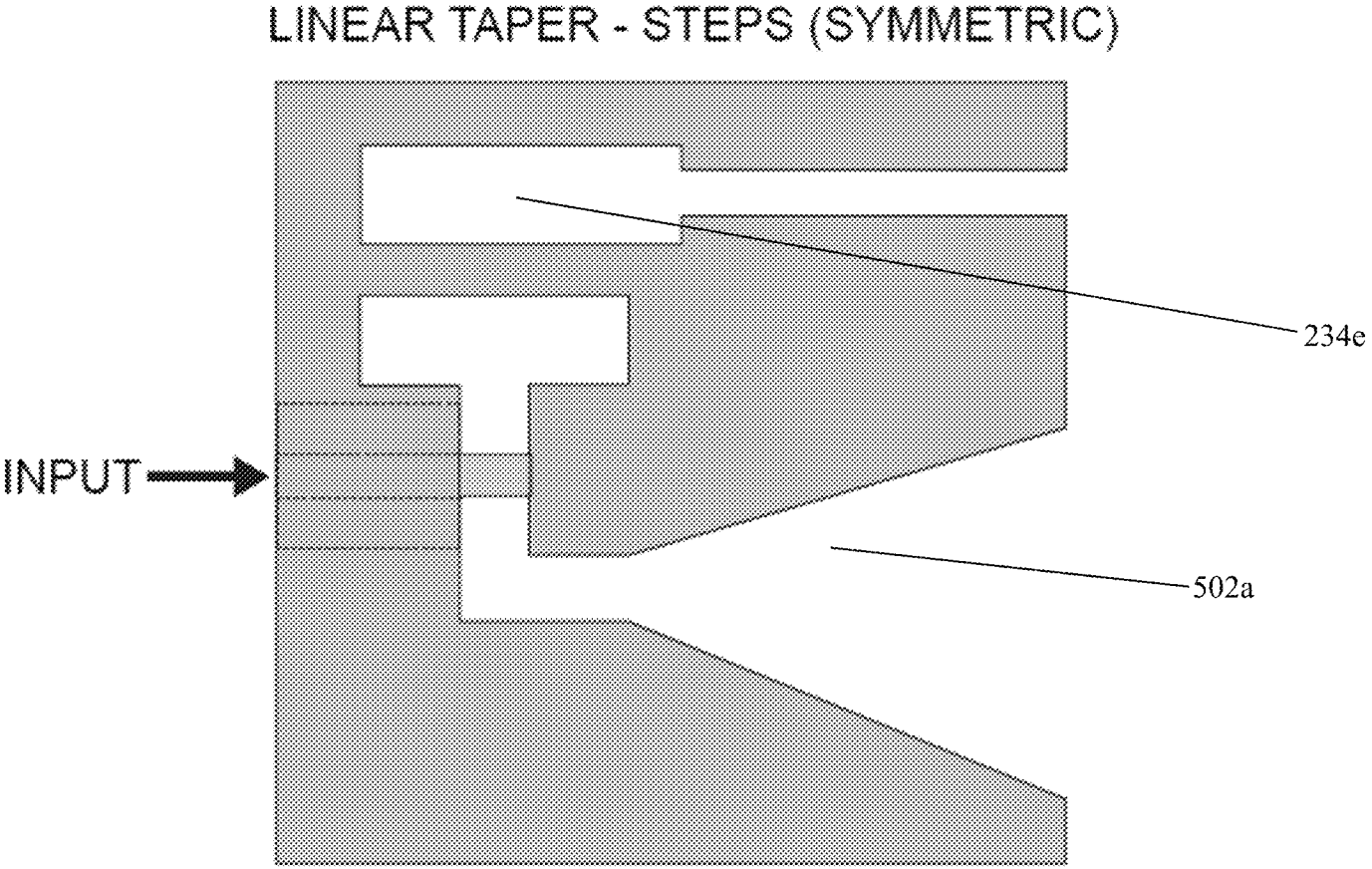
Figure 5D:
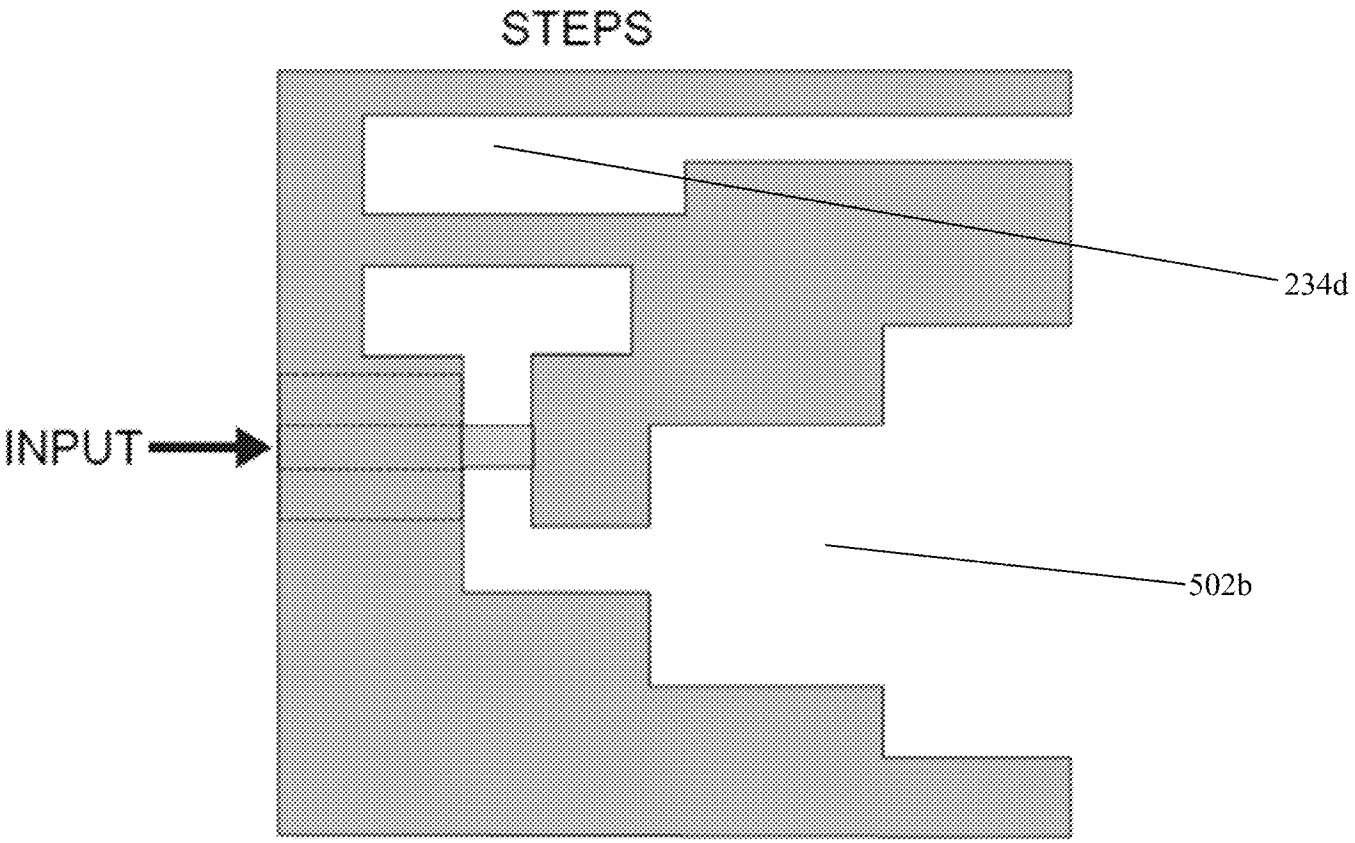
Figure 5E:
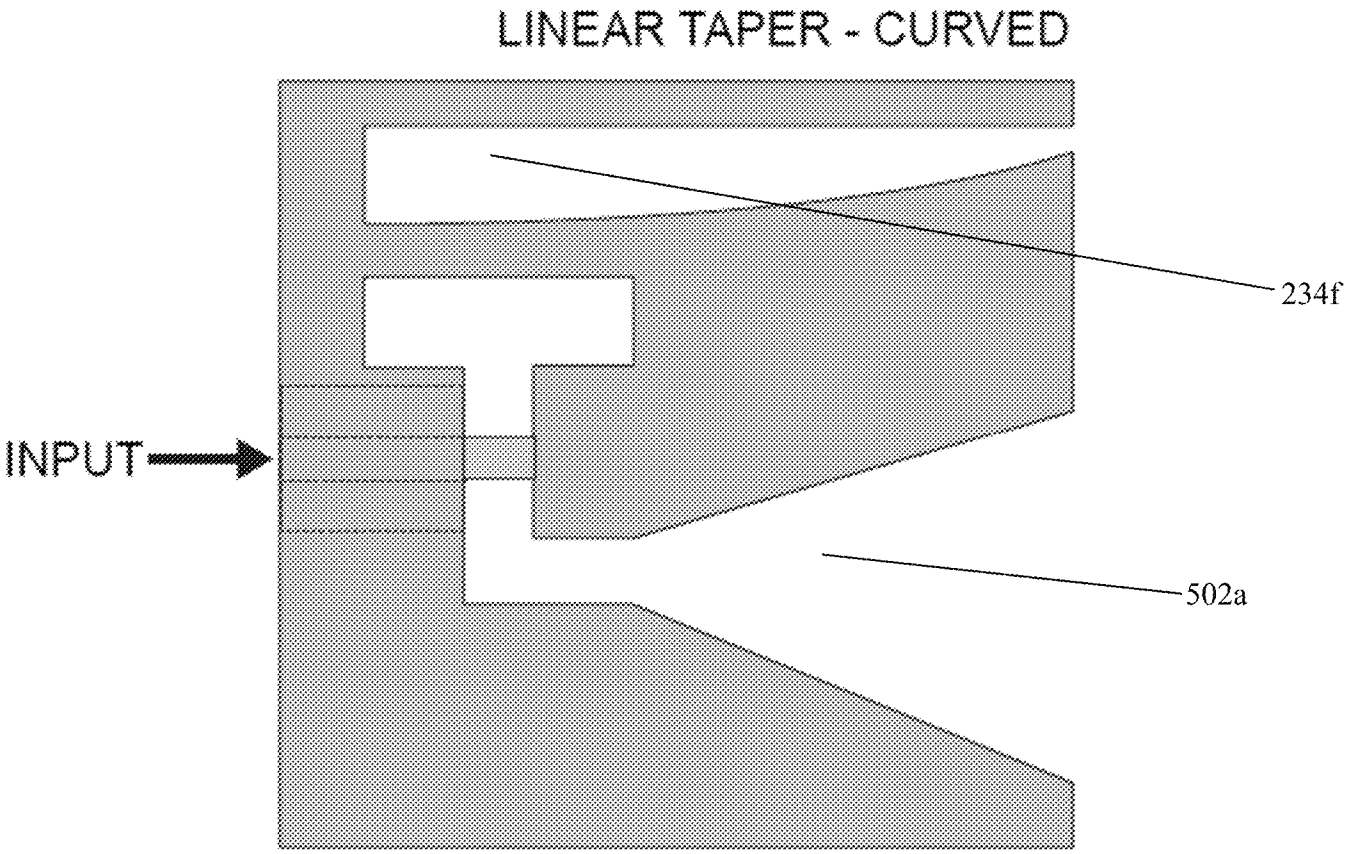
Figure 5F:
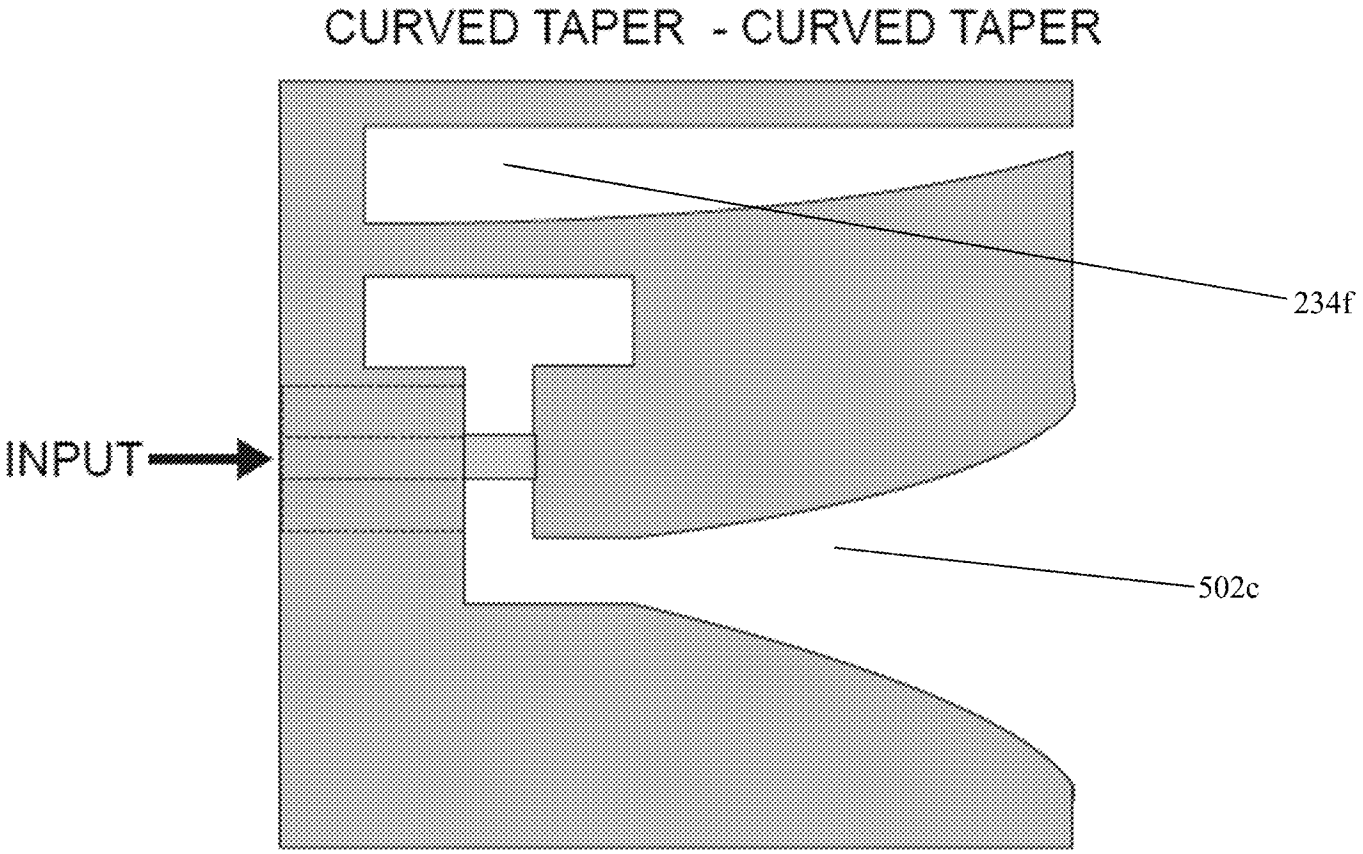
Figure 5G:
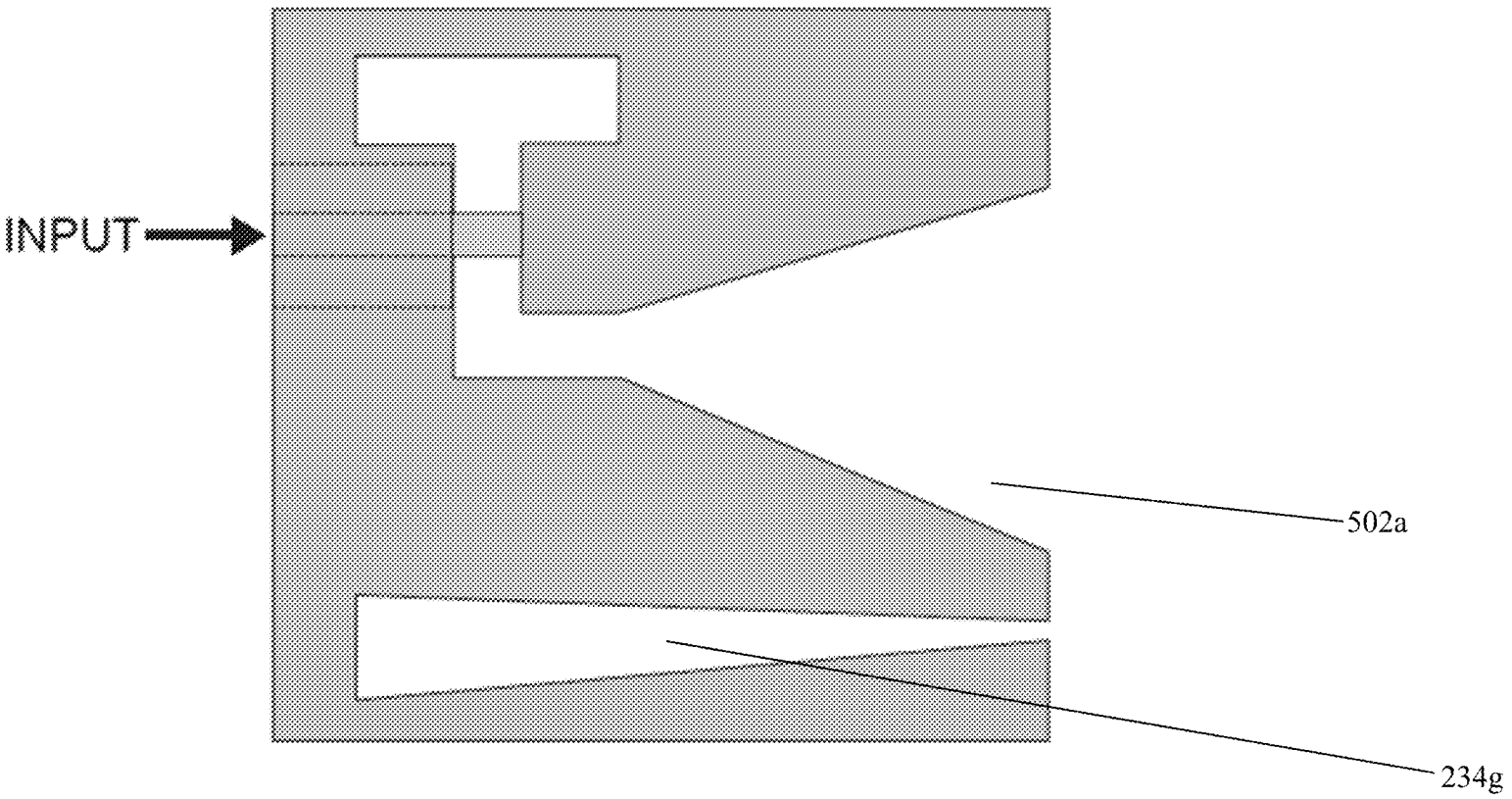

FIGS. 5A-5G show different possible configurations of an element including a shut-loaded gap 234 in accordance with embodiments of the present disclosure. In FIG. 5A, the cavity of shut-loaded gap 234 is configured using a linear taper 234*c*, and the element includes a cavity with a linear taper 502*a* that provides a smooth impedance transition from a low impedance near the coaxial feed to a higher space at the radiating end. In FIG. 5B, shut-loaded gap 234 is configured using asymmetric steps 234*d*, and the element includes a linear taper 502*a*. As shown in FIG. 5B, in an embodiment, asymmetric steps 234*d* include a space that is narrower at the radiating end of the element. In FIG. 5C, shut-loaded gap 234 is configured using symmetric steps 234*e*, and the element includes a linear taper 502*a*. In FIG. 5D, shut-loaded gap 234 is configured using asymmetric steps 234*d*, and the element includes a stepped taper 502*b*. In FIG. 5E, shut-loaded gap 234 is configured using a curved taper 234*f*, and the element includes a linear taper 502*a*. In FIG. 5F, shut-loaded gap 234 is configured using a curved taper 234*f*, and the element includes a curved taper 502*c*. In FIG. 5G, shut-loaded gap 234 is positioned below the input power feed instead of above the input power feed, and the element includes a linear taper 502*a*. Shunt-loaded gap 234 can be positioned at a variety of locations within the element in accordance with embodiments of the present disclosure.

As shown in FIGS. 2A-2C, in an embodiment, the element includes a first cavity to provide a smooth impedance transition from a lower impedance near the power feed to a higher impedance near a radiating end of the array element and a second cavity for shunt-loaded gap 234. In an embodiment, the first cavity includes a first subcavity positioned above the feed element (e.g., coaxial feed 224) and has an area (e.g., with length $s_c$ 230 and height $g_c$ 232) configured to improve impedance matching between the power feed and free space. In an embodiment, the first cavity includes a second subcavity positioned below the first subcavity and around the power feed that is narrower than the first subcavity. In an embodiment, the first cavity includes a third subcavity (e.g., with taper 502) that provides a smooth impedance transition from a lower impedance near the power feed to a higher impedance near a radiating end of the array element.

In an embodiment, the power feed port can be coaxial or stripline, can have spring-loaded interconnections such as commercially-available pogo pins, fuzz buttons, etc. In an embodiment, the conductive wall can be a full or partial wall, i.e., it can also be thinner than the thickness of the antenna element body. In a dual-polarization embodiment, the conductive wall can be constituted by one side of the orthogonal antenna element body, providing a different means of mechanical support (which can be referred to as a "dual-boomerang").

In an embodiment, the wall is conductive; however, the wall can be nonconductive in some embodiments. In an embodiment, the wall can perform electrical RF matching and can provide mechanical support as a form of load-bearing structure. In an embodiment, the wall can take on a plurality of shapes, e.g., circular, pyramidal, square, rectangle, with varying thicknesses and widths/radii/etc. Embodiments of the present disclosure can be directed to a linear array or a planar array of a plurality of antenna elements, in addition to a circular array or a cylindrical array of a plurality of antenna elements.

In an embodiment, a ground plane is not necessary to achieve the desired electrical performance. For example, in an embodiment, the antenna element impedance is not as sensitive to a ground plane, unlike dipole arrays that require a conductive ground plane for uni-directional radiation and thus plays an integral role in the impedance transformation to free-space. However, in an embodiment, a ground plane or conductive plate can be optionally included beneath the array. In an embodiment, the ground plane can include slits to insert the elements into like cartridges, and the ground plane can be made level above the bottom end of the antenna element body, e.g., at the base of the slot-line cavity.

In an embodiment, while notch elements can have a smooth outward tapered slot or flare, the "shaped slot" of this element doesn't have to be oriented in this way and can also be irregular or "bumpy," forming a "plurality" of flared or stepped notch distributions towards the top end of the element that aid wideband impedance matching. The antenna element body and/or array can be constructed as a single part or as multiple parts in accordance with embodiments of the present disclosure.

In an embodiment, a support material/post/beam can be inserted in the capacitive-coupled gap. In an embodiment, this helps maintain structure in an environment that may experience vibrations or movement. In an embodiment, the material can also augment the capacitive-coupling to aid impedance matching or broadband performance, notably at lower operational frequencies. In an embodiment, the orthogonal polarization can be replaced by a conductive wall, forming a single-polarization embodiment. In an embodiment, a radome or wide angle impedance matching (WAIM) layer or frequency-selective surface (FSS) or Superstrate Polarization and Impedance Rectifying Elements (SPIRE) could optionally be added on top of the element for select applications.

Figure 6:
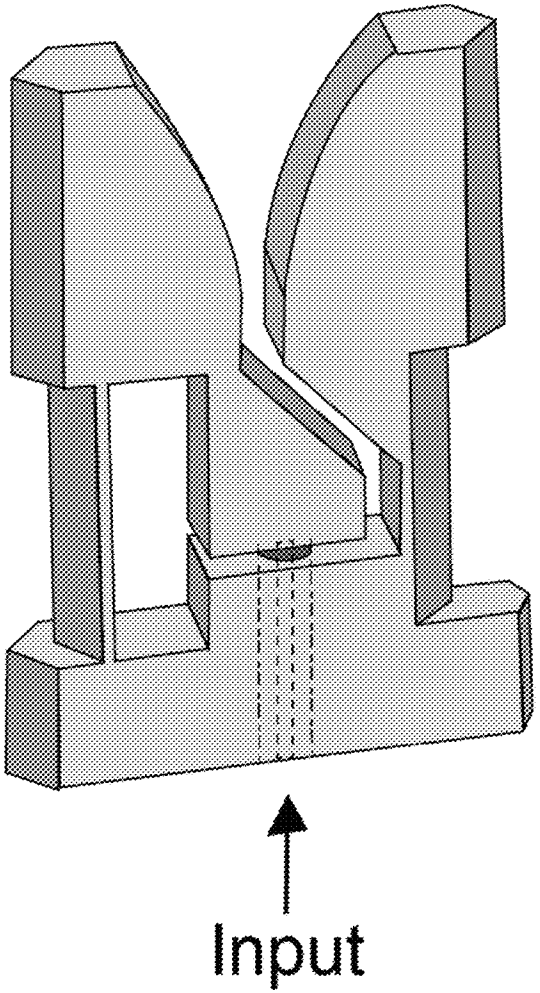
FIG. 6 is a diagram showing a single element in accordance with an embodiment of the present disclosure.

FIG. 6 is a diagram showing a single element in accordance with an embodiment of the present disclosure. FIG. 3 is an isometric depiction of the diagram of FIG. 2C.

Figure 7:
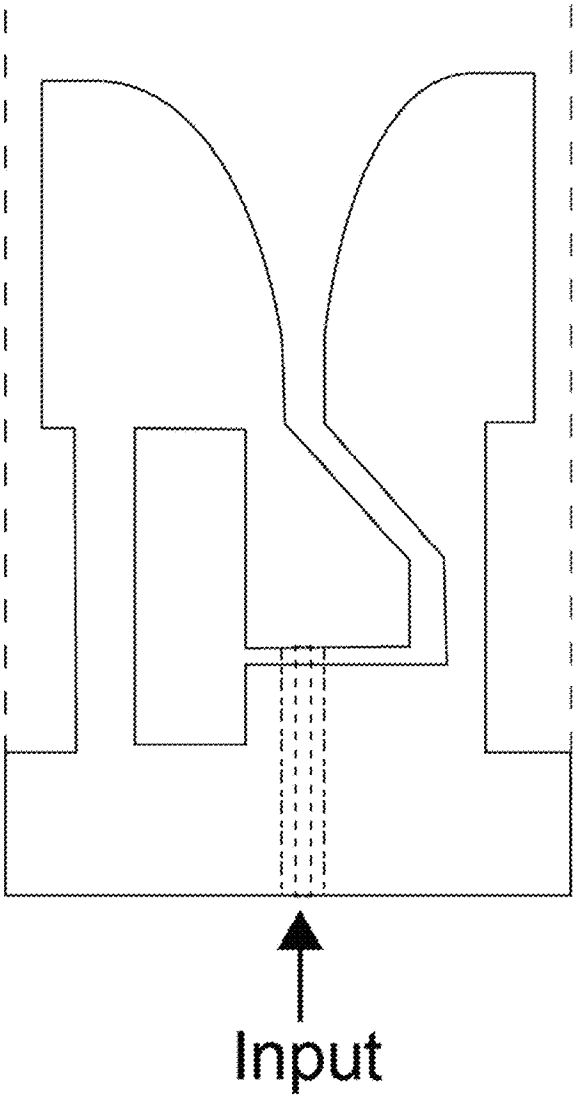
FIG. 7 is a diagram showing a cross-section of a single element in accordance with an embodiment of the present disclosure.

FIG. 7 is a diagram showing a cross-section of a single element in accordance with an embodiment of the present disclosure.

Figure 8A:
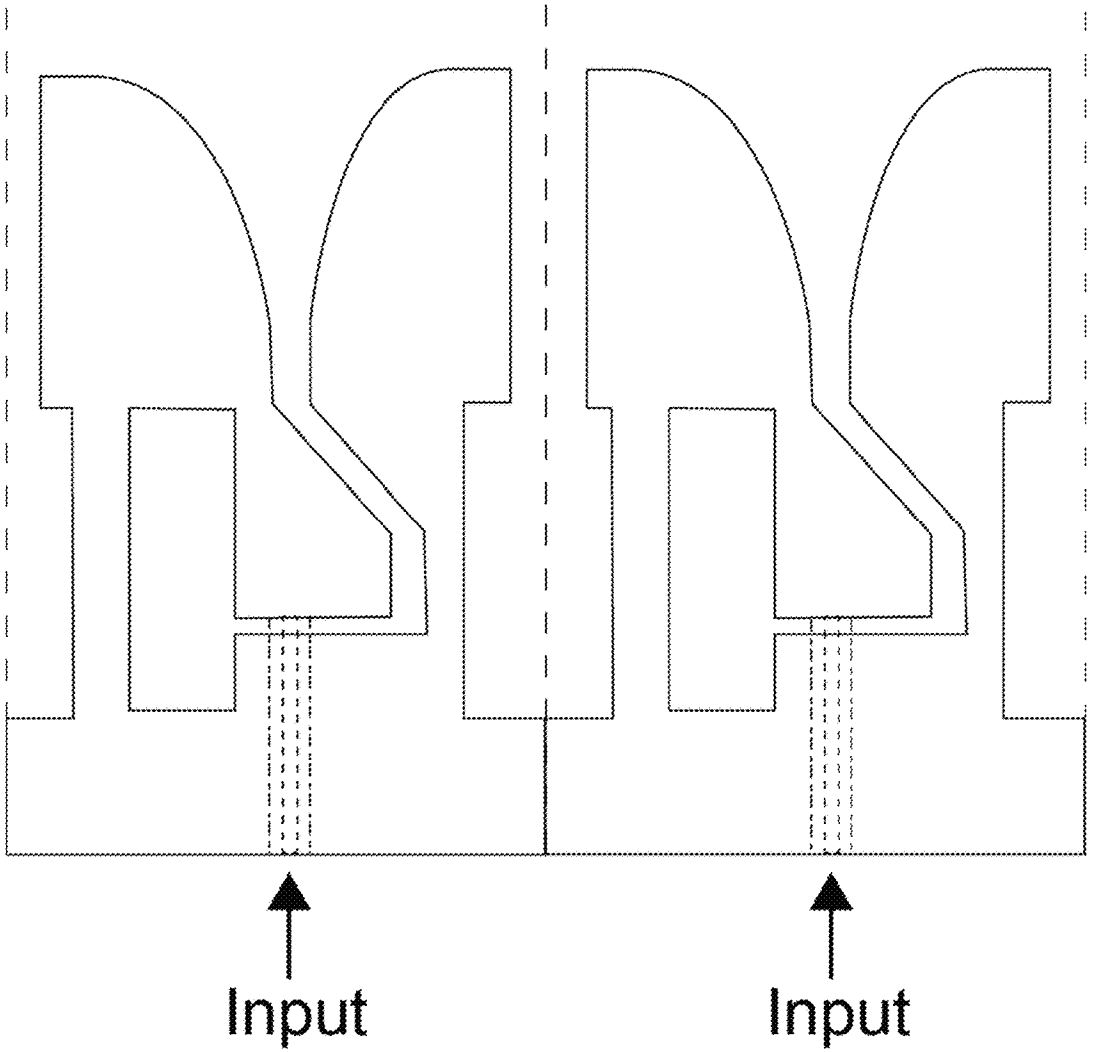
FIG. 8A is a diagram showing a cross-section of two elements arrayed together in accordance with an embodiment of the present disclosure.

FIG. 8A is a diagram showing a cross-section of two elements arrayed together in accordance with an embodiment of the present disclosure.

Figure 8B:
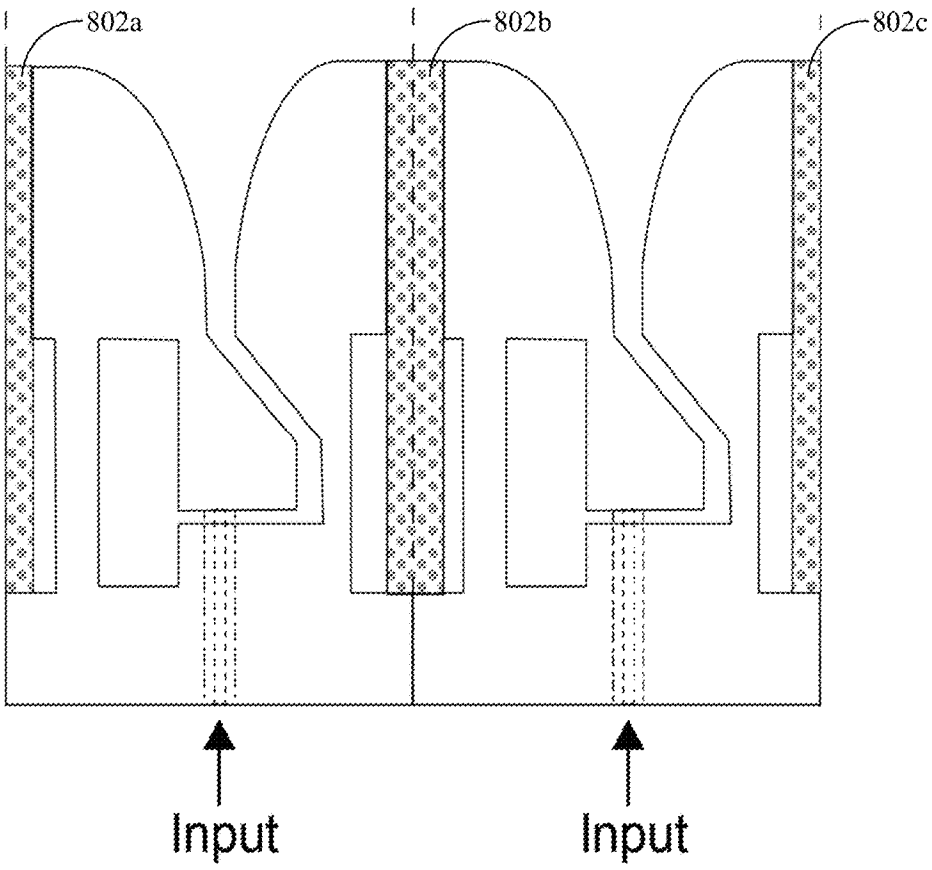
FIG. 8B is a diagram showing a cross-section of two elements arrayed having non-conductive support spacers in accordance with an embodiment of the present disclosure.

FIG. 8B is a diagram showing a cross-section of two elements arrayed having non-conductive support spacers 802 in accordance with an embodiment of the present disclosure.

Figure 9:
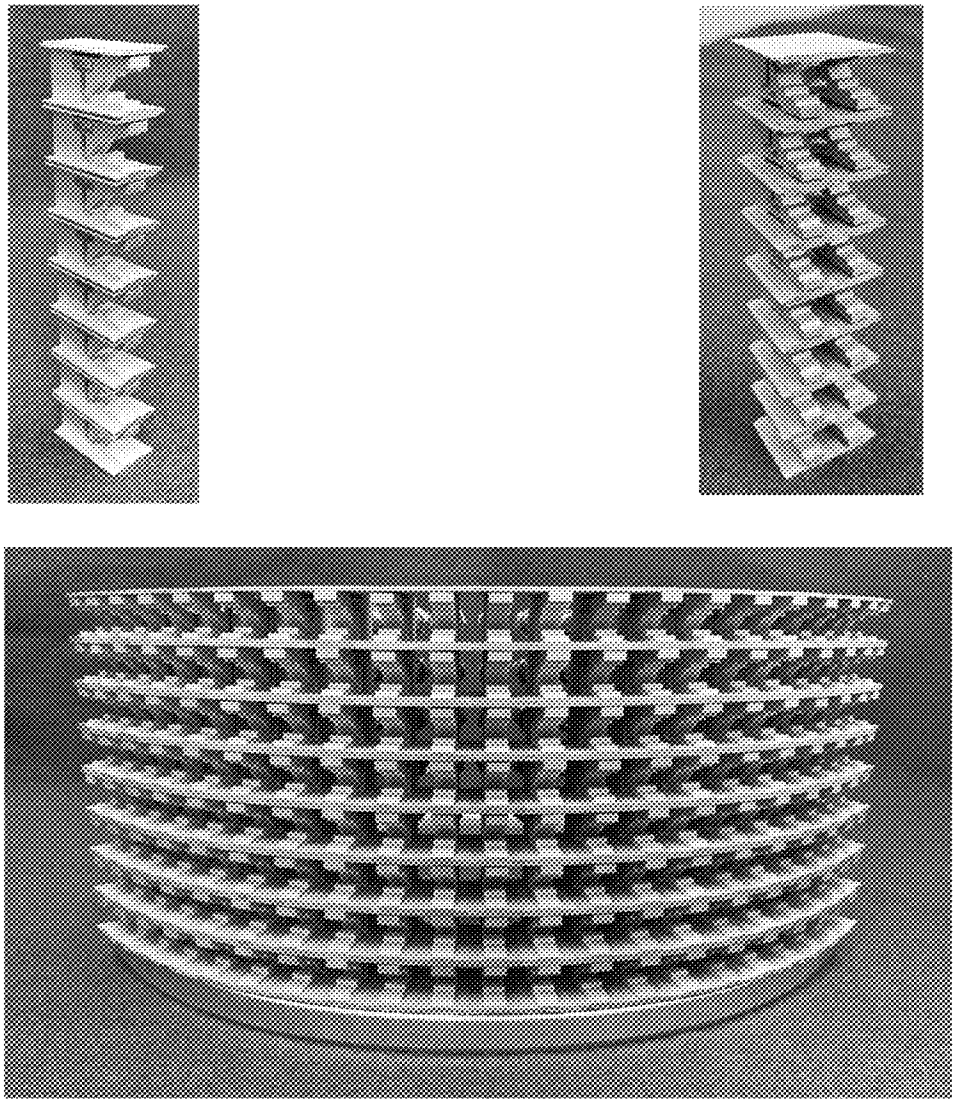
FIG. 9 shows images of a cylindrical array in accordance with an embodiment of the present disclosure.

FIG. 9 shows images of a cylindrical array in accordance with an embodiment of the present disclosure. In an embodiment, a cylindrical configuration can reduce space taken up by an array in accordance with some embodiments of the present disclosure (e.g., when implemented into a cylindrical platform, such as a periscope). Additionally, in an embodiment, a cylindrical array has advantages over a planar array for a 360° horizon coverage.

Figure 10:
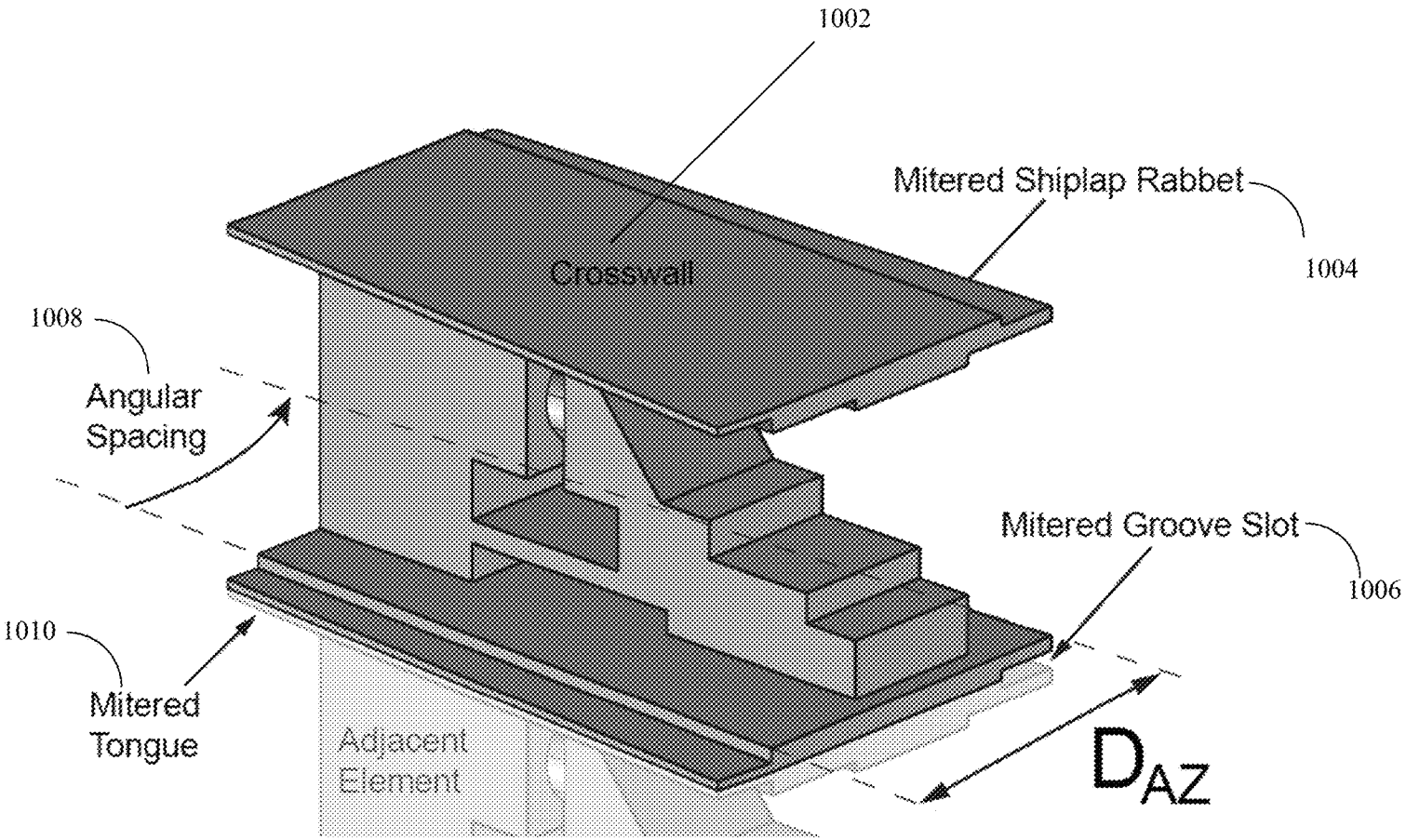
FIG. 10 is a diagram showing elements of a cylindrical array in accordance with an embodiment of the present disclosure.

FIG. 10 is a diagram showing elements of a cylindrical array in accordance with an embodiment of the present disclosure. In FIG. 10, an element includes a crosswall 1002 that enables elements to be coupled, a mitered shiplap rabbet 1004 (e.g., to attach adjacent elements), a mitered groove slot 1006 (e.g., for connecting elements in a column), angular spacing 1008 in the azimuth direction, and a mitered tongue 1010.

Figure 11:
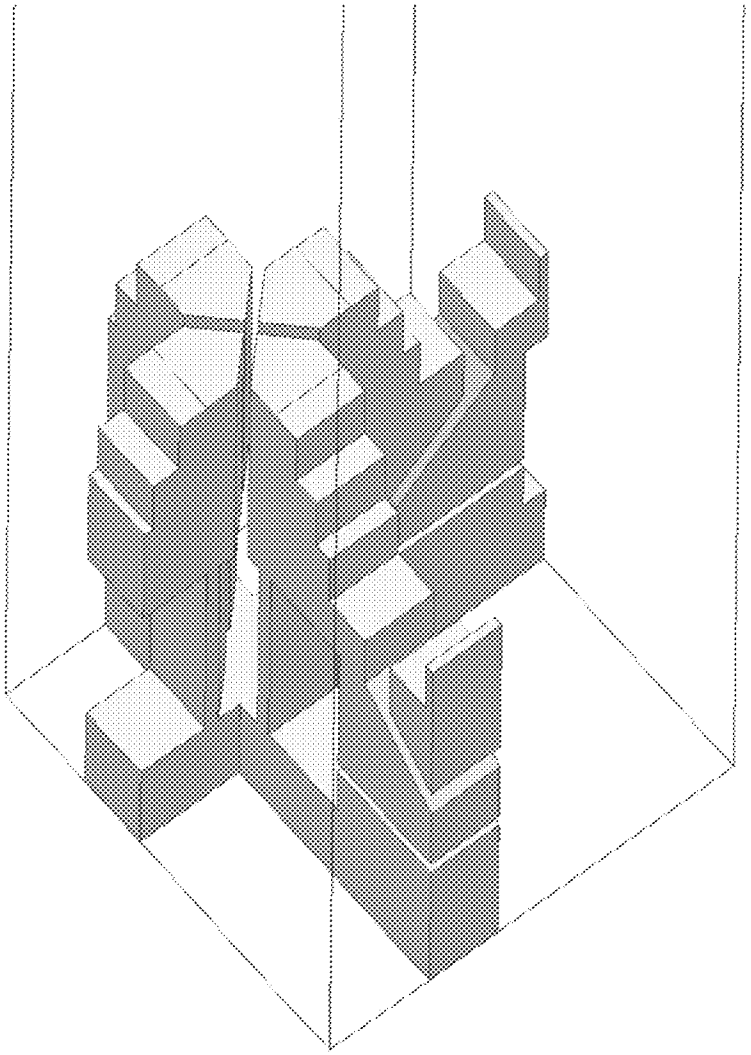
FIG. 11 is a diagram showing an isometric CAD model of a dual-polarized planar array unit-cell in accordance with an embodiment of the present disclosure.

FIG. 11 is a diagram showing an isometric CAD model of a dual-polarized planar array unit-cell in accordance with an embodiment of the present disclosure.

Figure 12:
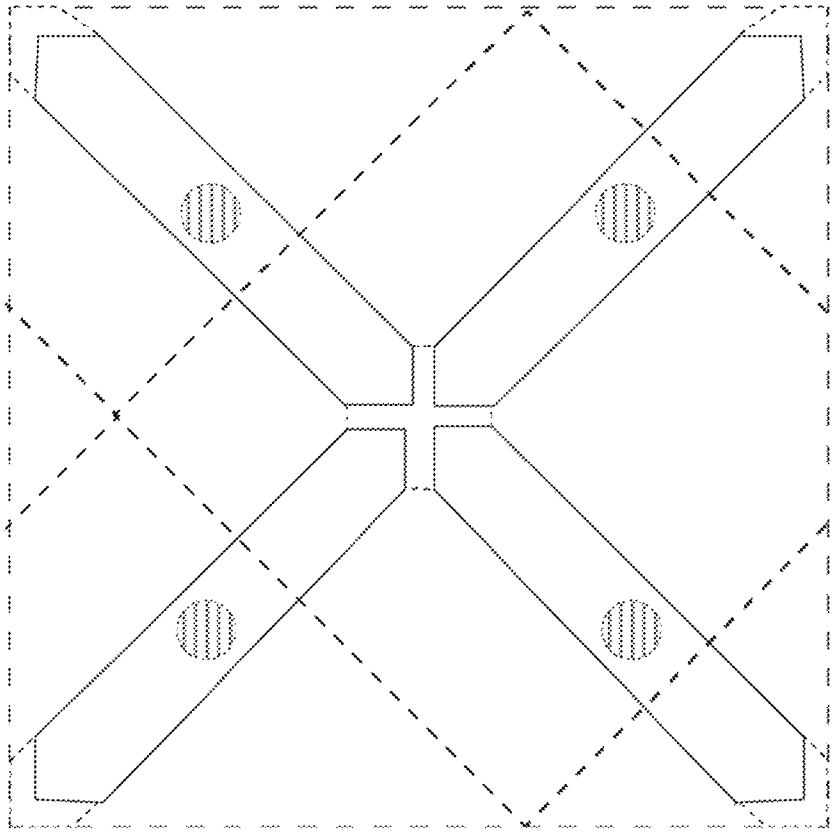
FIG. 12 is a diagram showing a top view of four elements in a quadrature arrangement in accordance with an embodiment of the present disclosure.

FIG. 12 is a diagram showing a top view of four elements in a quadrature arrangement in accordance with an embodiment of the present disclosure. In FIG. 12, the dotted lines represent unit cell boundaries.

Figure 13:
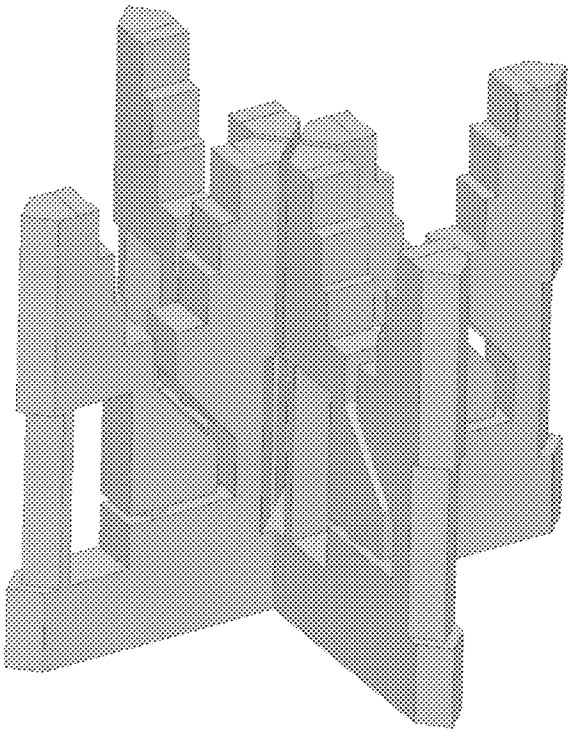
FIG. 13 is a diagram showing an isometric view of four elements in a quadrature arrangement in accordance with an embodiment of the present disclosure.

FIG. 13 is a diagram showing an isometric view of four elements in a quadrature arrangement in accordance with an embodiment of the present disclosure. FIG. 10 shows that notch steps can be irregular in accordance with an embodiment of the present disclosure without necessarily requiring a smooth widening taper.

Figure 14:
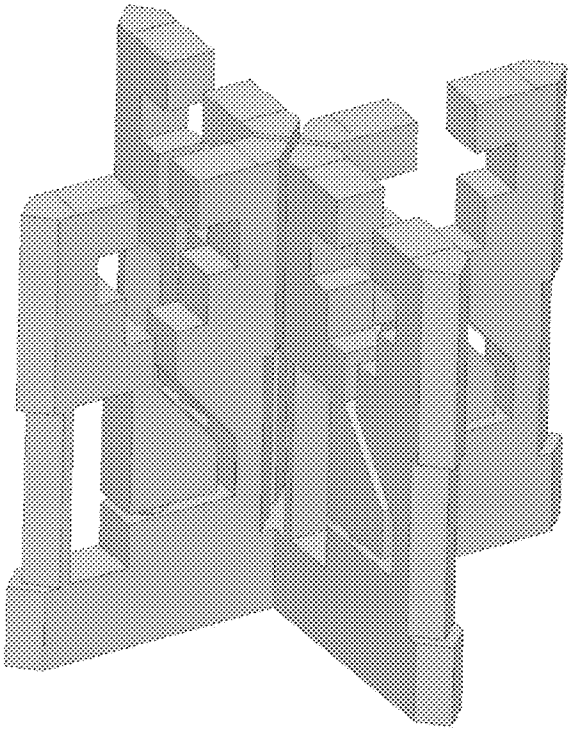
FIG. 14 is a diagram showing an isometric view of four elements in a quadrature arrangement with an irregular notch step at radiating-end in accordance with an embodiment of the present disclosure.

FIG. 14 is a diagram showing an isometric view of four elements in a quadrature arrangement with an irregular notch step at radiating-end in accordance with an embodiment of the present disclosure.

Figure 15:
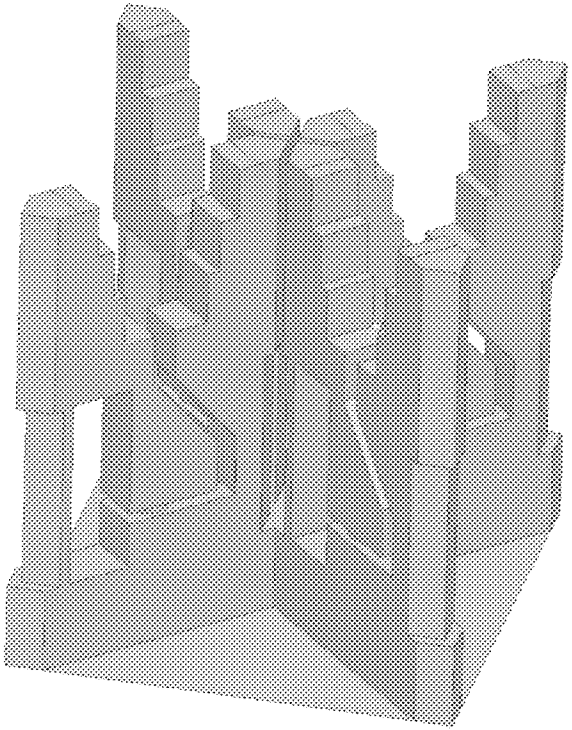
FIG. 15 is a diagram showing an isometric view of four elements in a quadrature element on a conductive ground plane in accordance with an embodiment of the present disclosure.

FIG. 15 is a diagram showing an isometric view of four elements in a quadrature element on a conductive ground plane in accordance with an embodiment of the present disclosure. Conductive ground planes can either be included or not required in accordance with embodiments of the present disclosure.

Figure 16:
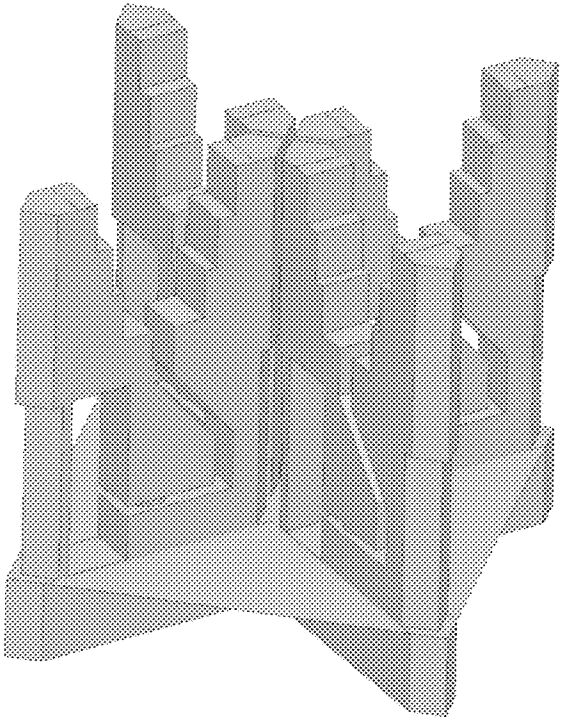
FIG. 16 is a diagram showing an isometric view of four elements in a quadrature element seated through a conductive ground plane in accordance with an embodiment of the present disclosure.

FIG. 16 is a diagram showing an isometric view of four elements in a quadrature element seated through a conductive ground plane in accordance with an embodiment of the present disclosure. As shown in FIG. 16, in an embodiment, the antenna ca be "holstered" as cartridges through a ground plane.

Figure 17:
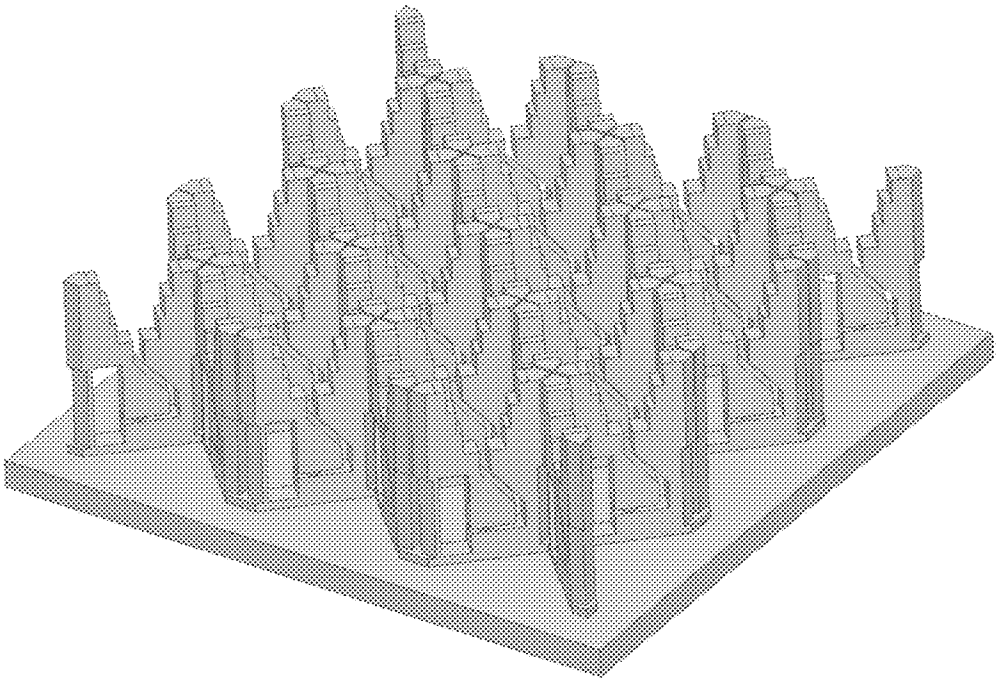
FIG. 17 is a diagram showing an isometric view of a 3×3 array of quadrature elements seated through a thick conductive ground plane in accordance with an embodiment of the present disclosure.

FIG. 17 is a diagram showing an isometric view of a 3×3 array of quadrature elements seated through a thick conductive ground plane in accordance with an embodiment of the present disclosure.

Figure 18:
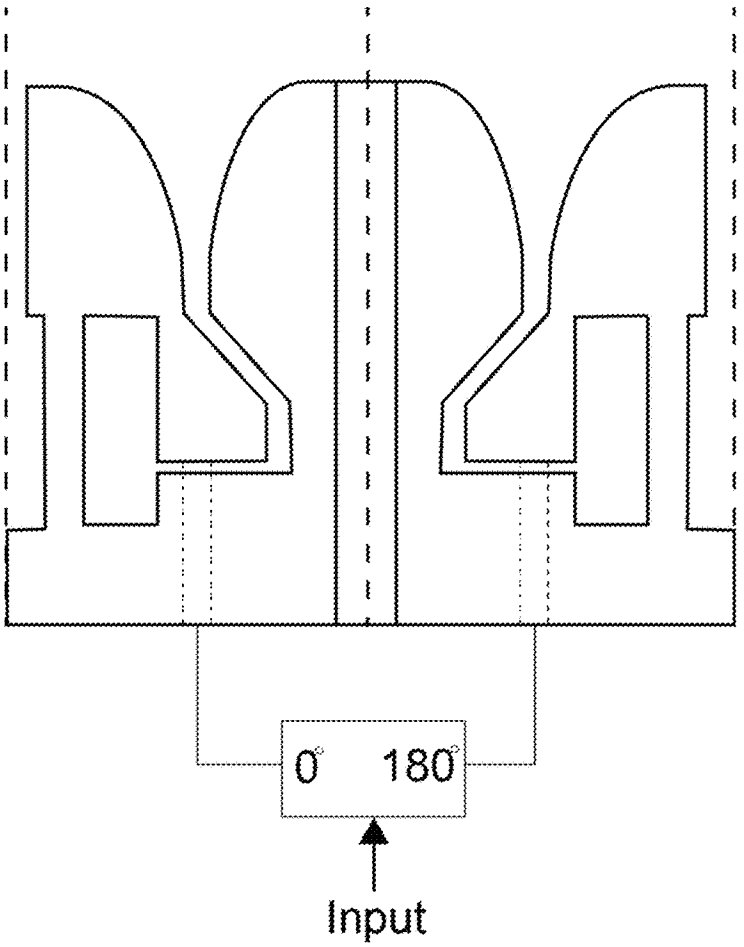
FIG. 18 is a diagram showing a cross-section of a coincident-phase center quadrature element with differential feed input in accordance with an embodiment of the present disclosure.

FIG. 18 is a diagram showing a cross-section of a coincident-phase center quadrature element with differential feed input in accordance with an embodiment of the present disclosure. In FIG. 18, two adjacent elements are mirrored with a differential feed input.

Figure 19:
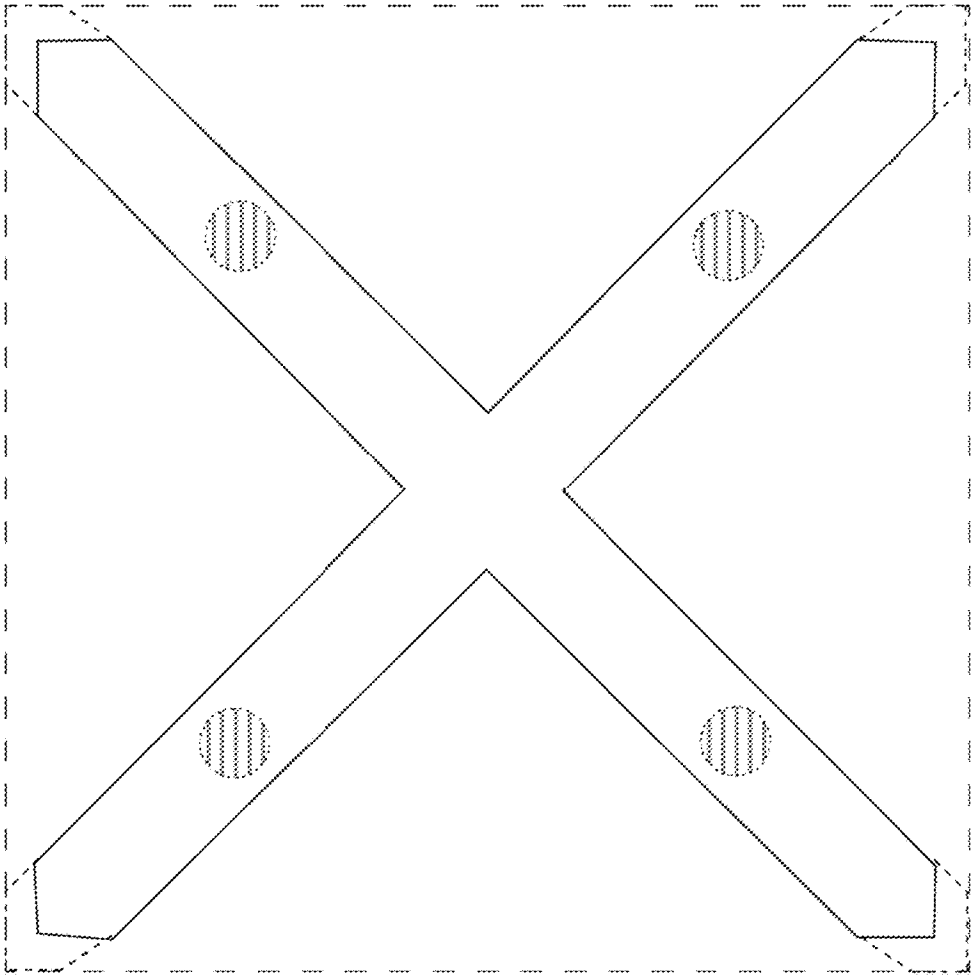
FIG. 19 is a diagram showing a top view of a coincident-phase center quadrature element in accordance with an embodiment of the present disclosure.

FIG. 19 is a diagram showing a top view of a coincident-phase center quadrature element in accordance with an embodiment of the present disclosure.

Figure 20:
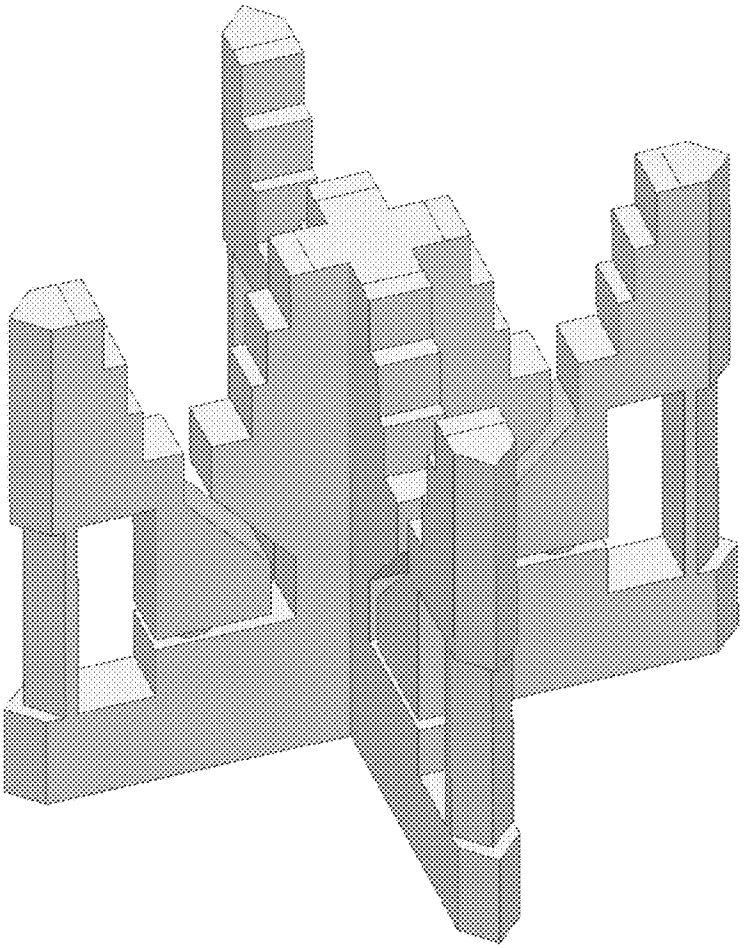
FIG. 20 is a diagram showing an isometric view of a coincident-phase center quadrature element in accordance with an embodiment of the present disclosure.

FIG. 20 is a diagram showing an isometric view of a coincident-phase center quadrature element in accordance with an embodiment of the present disclosure.

Figure 21:
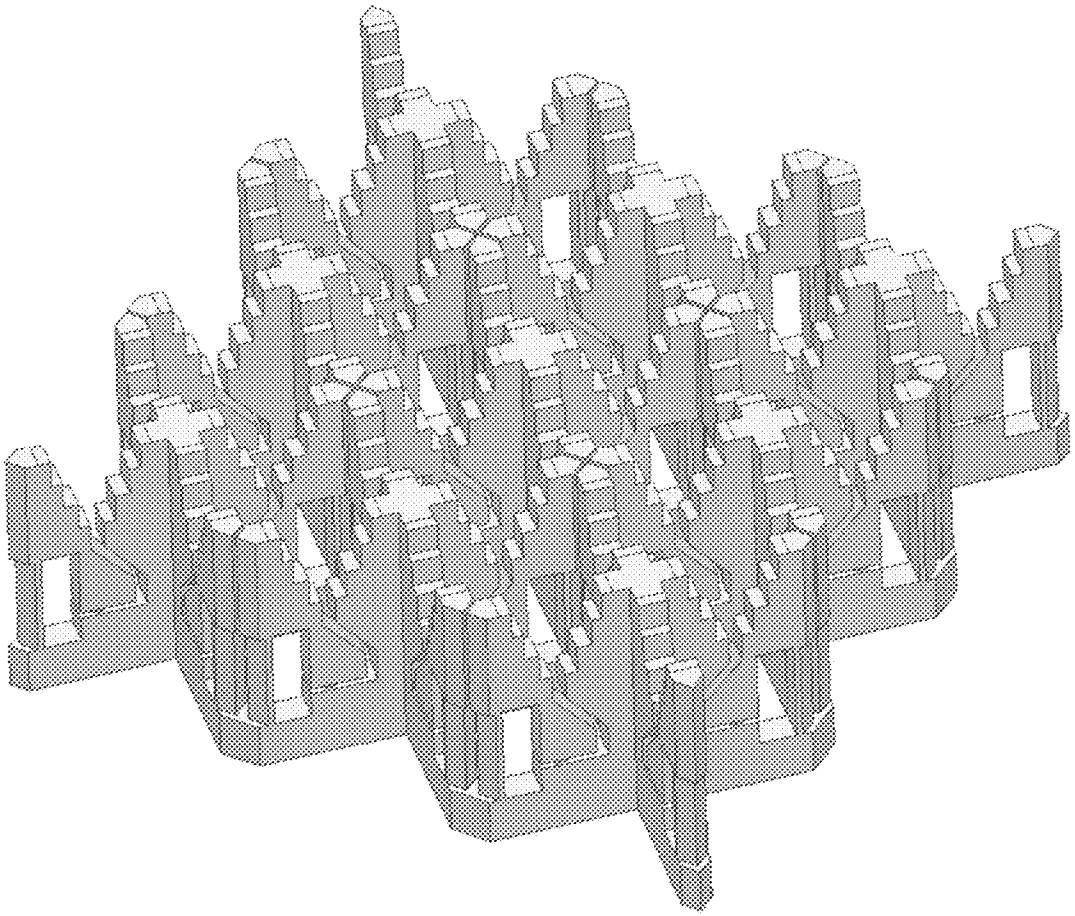
FIG. 21 is a diagram showing an isometric view of a 3×3 array of coincident-phase center quadrature elements in accordance with an embodiment of the present disclosure.

FIG. 21 is a diagram showing an isometric view of a 3×3 array of coincident-phase center quadrature elements in accordance with an embodiment of the present disclosure.

5. Exemplary Advantages

Embodiments of the present disclosure provide theory, design, fabrication, and measurement of a shunt-loaded UWB notch element for a multifunction array platform, such as a cylindrical array platform. The shunt-loaded UWB notch element promotes ease of cylindrical aperture assembly and scalability with a devised modular tongue-and-groove azimuthal crosswall scheme that conforms to the wedge-shaped unit cell for simple press-fit mating of column facets. In an embodiment, columns are made of lightweight aluminum machined with high precision and build repeatability.

Operating theory for a strategic shunt-loaded broadbanding method in accordance with an embodiment of the present disclosure was shown to exhibit analogous behavior to traditional compact stepped-impedance bandpass filter design. Findings were applied to insert and configure gaps between short notch elements that enable lowering of the array cutoff frequency and control of well-known gap-induced resonances as predicted by basic circuit analysis. A method in accordance with an embodiment of the present disclosure can be used to reduce array cutoff in the original notch element by 30% to meet bandwidth requirements without increasing depth or compromising the structural integrity or feed.

An arc array in accordance with an embodiment of the present disclosure can be designed to be large enough to demonstrate operation at the low frequency while remaining cost-effective and can show good performance despite its small electrical size and lack of edge treatment. In an embodiment, measurements are in good agreement with full-wave simulations, validating broadband impedance and pattern performance with little angle and frequency dependent ripple for low azimuthal side lobe control. Results demonstrate the feasibility and importance of modern full-wave computational tools to accurately predict complex conformal finite array behavior for one-to-one measurement comparisons. An element in accordance with an embodiment of the present disclosure is suited for small-diameter platform with broadband requirements, and may represent an economical option for commercial applications requiring 360° horizon coverage and UWB operation, e.g., base stations for 5G and beyond. Though only single-polarization was used here, dual-polarization designs are possible in accordance with embodiments of the present disclosure. Theoretical design findings can be similarly extended to benefit size, weight, and bandwidth constraints in legacy notch-based planar array systems.

Embodiments of the present disclosure achieve UWB operation at reduced element depth and lighter weight than a traditional notch antenna element counterpart. As such, an array of this type can support multifunction or multiuse roles on platforms that may have more stringent volume and weight requirements. In one such representative example, an element according an embodiment of the present disclosure can achieve an instantaneous bandwidth ratio of more than 4.5:1 with VSWR<2 at broadside scan at a nominal depth of 1.25 times the element spacing (i.e., approximately 0.75 wavelengths at the high operating frequency), though higher bandwidth ratios of 7:1 or more are possible in more finely-tuned designs (without increasing element depth). It is important to note that, in accordance with an embodiment of the present disclosure, this same performance can be achieved with and without including a conductive ground plane or back-plate beneath or near the base of the antenna element body. In an embodiment, the reduced element depth can have benefits in improving polarization purity when scanning off-axis towards inter-cardinal planes in planar arrays, in addition to aiding phase center stability. In an embodiment, the antenna element operational band is frequency scalable by linearly scaling the antenna element volume dimensions.

In an embodiment, the antenna element is a modularized sub-array assembly without contiguous (hard) electrical contact, e.g., soldering, bolting, etc. This is an intended byproduct of the capacitively-coupled gaps, i.e., noncontiguous electrical contact between adjacent antenna elements, present at the edges of the antenna element. In one such embodiment, the antenna element or its sub-array may be vertically-integrated to a conductive or non-conductive host holster, akin to a cartridge.

In an embodiment of the present disclosure, the antenna element has an insensitive nature to a conductive ground plane or back-plate, relative to dipole-type elements. This eases integration with system front-ends and reduces risk since the antenna element is less sensitive to installations that may have ground plane imperfections or features that differ from the original design.

In an embodiment, the antenna element can be fabricated as a single or reduced number of parts. This includes, for example, hard-metal subtractive manufacturing methods and electroplated additive manufacturing methods. The former tends to appeal to higher power handling and structural robustness to a greater degree in the current state-of-the-art.

In an embodiment, the antenna element has a simple single-ended 50 ohm feed that is inserted and housed within the antenna element body. This has particular benefits over dipole type elements that may have a floating feed pin that is sensitive to alignment and movement, or further may require internal or external balun circuitry to ensure balanced differential feed line operation and mitigate common-mode type resonances.

Embodiments of the present disclosure provide a notch-based element that retains traditional notch UWB performance while having a highly-producible/-scalable structure, high power handling, a simple single-ended 50 ohm feeding, and relative insensitivity to a conductive back-plate. Embodiments of the present disclosure also improve upon the traditional notch structure to further offer shorter element depth, lighter weight, and modularized assembly. The latter appeals to more weight-/volume-sensitive platforms and reduces assembly labor cost.

Embodiments of the present disclosure provide notch elements that enable designs for ease of fabrication and assembly as modules using scalable manufacturing techniques with simple feeding housed inside the antenna element body, require no floating feed pins, solder, or external baluns. Further, embodiments of the present disclosure minimize the number of parts with a solid antenna element body structure and maximize the number of common parts. Embodiments of the present disclosure enable multiuse and multifunction designs.

Embodiments of the present disclosure behave more as a traveling wave element than a typical dipole, thus becoming less sensitive to a proximate ground plane and retaining performance without dependence on a conductive back-plate. Embodiments of the present disclosure appeal to a planar array (rectangular cell) or cylindrical array (wedge cell). Embodiments of the present disclosure offer wideband performance (>6:1 bandwidth with good matching VSWR<2 at broadside scan possible). Further, embodiments of the present disclosure support single or dual-polarization and retain a short element depth (approximately equal to the element spacing, i.e., half-wavelength at the high operating frequency).

6. Conclusion

It is to be appreciated that the Detailed Description, and not the Abstract, is intended to be used to interpret the claims. The Abstract may set forth one or more but not all exemplary embodiments of the present disclosure as contemplated by the inventor(s), and thus, is not intended to limit the present disclosure and the appended claims in any way.

The present disclosure has been described above with the aid of functional building blocks illustrating the implementation of specified functions and relationships thereof. The boundaries of these functional building blocks have been arbitrarily defined herein for the convenience of the description. Alternate boundaries can be defined so long as the specified functions and relationships thereof are appropriately performed.

The foregoing description of the specific embodiments will so fully reveal the general nature of the disclosure that others can, by applying knowledge within the skill of the art, readily modify and/or adapt for various applications such specific embodiments, without undue experimentation, without departing from the general concept of the present disclosure. Therefore, such adaptations and modifications are intended to be within the meaning and range of equivalents of the disclosed embodiments, based on the teaching and guidance presented herein. It is to be understood that the phraseology or terminology herein is for the purpose of description and not of limitation, such that the terminology or phraseology of the present specification is to be interpreted by the skilled artisan in light of the teachings and guidance.

Any representative signal processing functions described herein can be implemented using computer processors, computer logic, application specific integrated circuits (ASIC), digital signal processors, etc., as will be understood by those skilled in the art based on the discussion given herein. Accordingly, any processor that performs the signal processing functions described herein is within the scope and spirit of the present disclosure.

While various embodiments of the present disclosure have been described above, it should be understood that they have been presented by way of example only, and not limitation. It will be apparent to persons skilled in the relevant art that various changes in form and detail can be made therein without departing from the spirit and scope of the disclosure. Thus, the breadth and scope of the present disclosure should not be limited by any of the above-described exemplary embodiments.

What is claimed is:

1. An array element of an antenna, comprising:

a power feed;

a first cavity etched into the array element, wherein the first cavity has a first length, and wherein the first cavity is configured to provide a smooth impedance transition from a lower impedance near the power feed to a higher impedance near a radiating end of the array element; and a second cavity etched into the array element, wherein the second cavity is positioned above the first cavity, and wherein the second cavity has a second length that is less than or equal to $\lambda/2$, wherein $\lambda$ represents a wavelength.

2. The array element of claim 1, wherein the second cavity is configured to improve low-frequency performance of the array element without increasing a profile of the array element.

3. The array element of claim 1, wherein the first length is approximately equal to the second length.

4. The array element of claim 1, wherein the second cavity has a linear taper.

5. The array element of claim 1, wherein the second cavity has a stepped taper.

6. The array element of claim 1, wherein the second cavity has a curved taper.

7. An array element, comprising:

a power feed;

a first cavity etched into the array element, wherein the first cavity has a first length, and wherein the first cavity includes:

a first subcavity positioned above the feed element, wherein the first subcavity has an area configured to improve impedance matching between the power feed and free space, a second subcavity positioned below the first subcavity and around the power feed, wherein the second subcavity is narrower than the first subcavity, and a third subcavity opening from a lower end of the second subcavity, wherein the third subcavity is configured to provide a smooth impedance transition from a lower impedance near the power feed to a higher impedance near a radiating end of the array element; and a second cavity etched into the array element, wherein the second cavity is positioned above the first cavity, and wherein the second cavity has a second length that is less than or equal to $\lambda/2$, wherein $\lambda$ represents a wavelength.

8. The array element of claim 7, wherein the third subcavity includes a taper that widens towards the radiating end of the array element.

9. The array element of claim 8, wherein the taper contains a plurality of steps.

10. The array element of claim 9, wherein the taper contains three steps.

11. The array element of claim 8, wherein the taper is linear.

12. The array element of claim 8, wherein the taper is curved.

13. An antenna array, comprising:

a first element, comprising:

a first power feed, a first cavity etched into the first element, wherein the first cavity has a first length, and wherein the first cavity is configured to provide a smooth impedance transition from a lower impedance near the first power feed to a higher impedance near a radiating end of the array element, and a second cavity etched into the first element, wherein the second cavity is positioned above the first cavity, and wherein the second cavity has a second length that is less than or equal to $\lambda/2$, wherein $\lambda$ represents a wavelength; and a second element, coupled to the first element, comprising;

a second power feed, a third cavity etched into the second element, wherein the third cavity has a third length, and a fourth cavity etched into the second element, wherein the fourth cavity is positioned above the third cavity, and wherein the fourth cavity has a fourth length that is less than or equal to $\lambda/2$.

14. The antenna array of claim 13, wherein the antenna array is a cylindrical array.

15. The antenna array of claim 14, wherein the second element includes a crosswall, a mitered shiplap rabbet, a mitered groove slot, and a mitered tongue coupling the second element to the first element.

16. The antenna array of claim 13, wherein the antenna array is a planar array.

17. The antenna array of claim 13, wherein the first cavity includes:

a first subcavity positioned above the feed element, wherein the first subcavity has an area configured to improve impedance matching between the power feed and free space;

a second subcavity positioned below the first subcavity and around the power feed, wherein the second subcavity is narrower than the first subcavity; and a third subcavity opening from a lower end of the second subcavity, wherein the third subcavity is configured to provide the smooth impedance transition from the lower impedance near the power feed to the higher impedance near the radiating end of the array element.

18. The antenna array element of claim 17, wherein the third subcavity includes a taper that widens towards the radiating end of the array element.

19. The antenna array of claim 17, wherein the taper contains a plurality of steps.

20. The antenna array of claim 17, wherein the taper is linear.

* * * * *